US009029055B2

(12) United States Patent
Aoki et al.

(10) Patent No.: US 9,029,055 B2
(45) Date of Patent: May 12, 2015

(54) MAGNETIC TONER

(75) Inventors: Kozue Aoki, Susono (JP); Yusuke Hasegawa, Suntou-gun (JP); Yoshitaka Suzumura, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/510,283

(22) PCT Filed: May 25, 2011

(86) PCT No.: PCT/JP2011/062553
§ 371 (c)(1),
(2), (4) Date: May 16, 2012

(87) PCT Pub. No.: WO2011/152434
PCT Pub. Date: Dec. 8, 2011

(65) Prior Publication Data

US 2012/0231384 A1 Sep. 13, 2012

(30) Foreign Application Priority Data

May 31, 2010 (JP) ..... 2010-123734

(51) Int. Cl.
*G03G 9/083* (2006.01)
*G03G 9/08* (2006.01)

(52) U.S. Cl.
CPC ..... *G03G 9/0835* (2013.01); *G03G 9/0802* (2013.01); *G03G 9/0804* (2013.01); *G03G 9/0833* (2013.01); *G03G 9/0834* (2013.01); *G03G 9/0836* (2013.01)

(58) Field of Classification Search
CPC . G03G 9/0834; G03G 9/0836; G03G 9/0833; G03G 9/0835; G03G 9/0802; G03G 9/0804
USPC ..... 430/106.1, 109.1, 137.1, 137.15, 430/137.17
See application file for complete search history.

(56) References Cited

U.S. PATENT DOCUMENTS 5,985,501 A * 11/1999 Sato et al. ..... 430/111.41
6,447,968 B1 9/2002 Ohno (Continued)

FOREIGN PATENT DOCUMENTS

CN 101432663 A 5/2009
CN 101589345 A 11/2009

(Continued)

OTHER PUBLICATIONS

Kawamura, et al., U.S. Appl. No. 13/510,606, 371(c) Date: May 17, 2012.

(Continued)

*Primary Examiner* — Christopher Rodee
*Assistant Examiner* — Omar Kekia
(74) *Attorney, Agent, or Firm* — Fitzpatrick, Cella, Harper and Scinto

(57) ABSTRACT

A magnetic toner which has superior charging stability and charging uniformity, maintains stable developing performance without any dependence on service environments and may less cause any decrease in image density and any image defects such as fog and ghost, the magnetic toner has magnetic toner particles, each of the magnetic toner particles has magnetic toner base particle containing a binder resin and a magnetic material, and an inorganic fine powder, (a) the magnetic toner having, at a frequency of 100 kHz and a temperature of 30° C., a dielectric loss factor ($\in''$) of $2.5\times10^{-1}$ pF/m or more and $7.0\times10^{-1}$ pF/m or less and a dielectric dissipation factor (tan $\delta_L$) of $3.0\times10^{-2}$ or less, (b) the magnetic toner having, in a dielectric dissipation factor (tan $\delta$) thereof at a frequency of 100 kHz, a maximum value (tan $\delta_H$) within the temperature range of 60° C. to 140° C.; and the tan $\delta_H$ and the tan $\delta_L$ satisfying (tan $\delta_H$−tan $\delta_L$)≤$3.0\times10^{-2}$.

6 Claims, 1 Drawing Sheet

(56) References Cited

U.S. PATENT DOCUMENTS

| | | | | |
|---|---|---|---|---|
| 6,447,970 | B1 * | 9/2002 | Matsunaga et al. | 430/108.3 |
| 6,586,151 | B1 | 7/2003 | Naka et al. | |
| 6,703,176 | B2 | 3/2004 | Naka et al. | |
| 6,803,164 | B2 | 10/2004 | Mizoo et al. | |
| 6,953,646 | B2 | 10/2005 | Doujo et al. | |
| 7,123,862 | B2 | 10/2006 | Hasegawa et al. | |
| 7,160,660 | B2 | 1/2007 | Dojo et al. | |
| 7,368,211 | B2 | 5/2008 | Hasegawa et al. | |
| 7,470,494 | B2 | 12/2008 | Nishiyama et al. | |
| 7,582,401 | B2 | 9/2009 | Ogawa et al. | |
| 7,678,524 | B2 | 3/2010 | Hasegawa et al. | |
| 7,704,659 | B2 | 4/2010 | Ogawa et al. | |
| 7,811,734 | B2 | 10/2010 | Ogawa et al. | |
| 7,939,231 | B2 | 5/2011 | Ogawa et al. | |
| 8,084,174 | B2 | 12/2011 | Hasegawa et al. | |
| 8,124,306 | B2 | 2/2012 | Hirata et al. | |
| 8,227,162 | B2 | 7/2012 | Sano et al. | |
| 2003/0044708 | A1 * | 3/2003 | Matsunaga et al. | 430/108.22 |
| 2006/0121379 | A1 | 6/2006 | Dojo et al. | |
| 2007/0072102 | A1 | 3/2007 | Dojo et al. | |
| 2009/0047043 | A1 * | 2/2009 | Dojo et al. | 399/252 |
| 2009/0186288 | A1 * | 7/2009 | Hirata et al. | 430/106.2 |
| 2009/0197192 | A1 | 8/2009 | Hiroko et al. | |
| 2011/0136054 | A1 | 6/2011 | Watanabe et al. | |
| 2011/0294056 | A1 | 12/2011 | Magome et al. | |
| 2011/0311910 | A1 | 12/2011 | Matsui et al. | |
| 2012/0094226 | A1 | 4/2012 | Tani et al. | |

FOREIGN PATENT DOCUMENTS

| | | | |
|---|---|---|---|
| JP | 10-239897 | A | 9/1998 |
| JP | 2000-3067 | A | 1/2000 |
| JP | 2002-341588 | A | 11/2002 |
| JP | 2003-195560 | A | 7/2003 |
| JP | 2003-330223 | A | 11/2003 |
| JP | 2005-157318 | A | 6/2005 |
| JP | 2008-15221 | A | 1/2008 |
| WO | 2009/057807 | A1 | 5/2009 |

OTHER PUBLICATIONS

PCT International Search Report and Written Opinion of the International Searching Authority, International Application No. PCT/JP2011/062553, Mailing Date Jun. 28, 2011.

Taiwanese Office Action dated Aug. 22, 2013 in Taiwanese Application No. 100118639.

Chinese Office Action dated Mar. 3, 2014 in Chinese Application No. 201180027048.6.

* cited by examiner

MAGNETIC TONER

TECHNICAL FIELD

This invention relates to a magnetic toner used in a recording process making use of electrophotography, electrostatic recording, electrostatic printing or toner jet system recording.

BACKGROUND ART

In recent years, image forming apparatus such as copying machines and printers are sought to achieve much higher speed, higher image quality and higher stability as they make progress in their use for various purposes and in various environments. For example, printers, which have ever been chiefly used in offices, have come to be used in severe environments, and it has become important for them to promise stable image quality even in such a case.

In copying machines and printers, the apparatus make progress in being made compact and energy saving at an aim to make them usable without preference for places where they are installed and environments where they are used, and a magnetic one-component developing system, which makes use of a magnetic toner, is preferably used as being advantageous in these respects. In the magnetic one-component developing system, the magnetic toner is held by using a toner carrying member (hereinafter "developing sleeve") provided in its interior with a magnetic-field generation means such as a magnet roll, and is transported to a developing zone to perform development. The magnetic toner is also provided with electric charges chiefly by triboelectric charging by the rubbing friction between the toner and a triboelectric charge providing member such as the developing sleeve.

In a low-temperature and low-humidity environment, where the magnetic toner tends to be electrostatically charged, a phenomenon called charge-up in which the toner greatly increases in charge quantity may come about to damage developing performance of the toner. That is, any toner having been charged up may remain on the developing sleeve, and this may cause a decrease in image density or may make the whole toner thereon charged non-uniformly to cause image defects such as fog. In order to resolve such a problem, many methods have been proposed in which conductive fine particles are added as an external additive to toner particles so as to control chargeability required as the toner. For example, it is widely known to use the magnetic toner in the state that carbon black has been made to adhere or stick firmly to toner particle surfaces in order to, e.g., keep the toner from being charged in excess and make its charge distribution uniform. However, the presence of such conductive fine particles on the toner particle surfaces may on the other hand be likely to make the toner charged non-uniformly or insufficiently in environments where electric charges tend to leak as in a high-temperature and high-humidity environment. Also, the rubbing friction between toner particles themselves or between the toner and a toner layer thickness control member may cause the external additive of the toner to come off or come buried in the toner particles, resulting in low charging stability.

As having such problems, in order to make the toner have stable developing performance even in severe environments, it is studied to improve its chargeability by controlling not the external additive but raw materials for the toner and controlling the state of their dispersion.

Studies made by the present inventors have revealed that a toner inside the toner particles of which a magnetic material is locally present and on the toner particle surfaces of which any magnetic material is substantially not present has a high resistance and tends to cause the charge-up because its particle surfaces are composed of a resin. Also, where the magnetic material is locally present or stands agglomerated in toner particles, the toner may have a non-uniform chargeability. As the result, tone non-uniformity called sleeve ghost may occur on images, or low density uniformity may result on solid black images.

In order to resolve the above problems, it is also proposed to control the dielectric dissipation factor (tan δ) that is an index of the state of dispersion of a magnetic material in toner particles, to make the toner stable against any changes in developing performance with environmental variations.

In PTL 1, the particle surface properties and particle shape of a magnetic material are controlled to make the magnetic material low agglomerative so as to make the magnetic material dispersible in the whole toner particles to control the dissipation factor (tan δ) of a toner, to thereby make the toner regulated on its chargeability and improved in its developing performance. Also, in PTL 2 and PTL 3, the dielectric dissipation factor (tan δ) in a high-temperature range and that in a normal-temperature range are controlled in an attempt to make the toner less change in its chargeability with environmental variations.

However, these methods are all directed toward how the magnetic material be dispersed in the whole toner particles, and hence it has been insufficient for the magnetic material to be kept from coming bare to toner particle surfaces. If the magnetic material stands bare to toner particle surfaces, the points where it stands bare thereto serve as leak sites of electric charges to cause charge insufficiency and further make the toner have non-uniform charge quantity distribution. In such a case, selective development takes place, where only a toner having an appropriate charge quantity participates in development and a toner having a low charge quantity comes to be accumulated inside a developing assembly to cause image defects such as fog.

Meanwhile, in PTL 4 and PTL 5, a magnetic material is made present within a stated distance from toner particle surfaces and also the magnetic material is kept from coming bare to toner particle surfaces, to thereby make a toner less change in its chargeability with environmental variations. For this end, the toner is so structured that magnetic material distributed layers where the magnetic material is present at a relatively high density are present in the vicinity of particle surfaces. The presence of the magnetic material in the vicinity of particle surfaces without standing bare thereto keeps the charge-up from occurring in a low-temperature and low-humidity environment and at the same time makes the selective development less take place that may come as the charge quantity distribution becomes broad. This keeps any decrease in image density and any image defects such as fog from occurring. Further, inasmuch as the magnetic material is kept from coming bare to toner particle surfaces, the electric charges are kept from leaking in a high-temperature and high-humidity environment, to make the toner have stable chargeability against any environmental variations.

However, since the magnetic material is present at a high density in the vicinity of toner particle surfaces, magnetic material particles may agglomerate one another in the toner particles. Such agglomeration of magnetic material particles one another is considered to be caused by any mutual attraction of hydroxyl groups one another which have remained on the particle surfaces when magnetic material particle surfaces have non-uniformly hydrophobic-treated. Such a state of dispersion of the magnetic material as viewed microscopically affects the charging uniformity of the toner, so that, where the development is performed at a high speed especially in severe environments for charging as in, e.g., a high-temperature and high-humidity environment, differences in charge quantity may come between toner particles themselves to cause sleeve ghost or density non-uniformity.

In PTL 6, it is proposed to use a magnetic material in which Si element level on the magnetic material particle surfaces is specified and at the same time the magnetic material particle surfaces have been modified with a surface modifying agent, to thereby improve a toner in its environmental stability. There, however, is further room for improvement as to making magnetic material particle surfaces uniformly hydrophobic. Making the magnetic material hydrophobic affects the state of dispersion of the magnetic material in toner particles, and besides affects also the water adsorption of the toner to greatly influence the stability of developing performance in a high-temperature and high-humidity environment.

CITATION LIST

Patent Literature

PTL 1: Japanese Patent Application Laid-Open No. 2003-195560

PTL 2: Japanese Patent Application Laid-Open No. 2005-157318

PTL 3: Japanese Patent Application Laid-Open No. 2003-330223

PTL 4: Japanese Patent Application Laid-Open No. 2008-015221

PTL 5: International Publication No. 2009/057807

PTL 6: Japanese Patent Application Laid-Open No. H10-239897

SUMMARY OF INVENTION

Technical Problem

The present invention has been made taking account of the problems the above prior art has had. More specifically, an object of the present invention is to provide a magnetic toner having superior uniformity in triboelectric charging between particles themselves of the toner and also superior charging stability, and having stable developing performance without any dependence on service environments. Another object of the present invention is to provide a magnetic toner that may less cause any decrease in image density and any image defects such as fog and ghost.

Solution to Problem

The present invention is concerned with a magnetic toner comprising magnetic toner particles, each of the magnetic toner particles comprises magnetic toner base particle containing a binder resin and a magnetic material, and an inorganic fine powder;

(a) the magnetic toner having, at a frequency of 100 kHz and a temperature of 30° C., a dielectric loss factor ($\in''$) of from $2.5\times10^{-1}$ pF/m or more to $7.0\times10^{-1}$ pF/m or less and a dielectric dissipation factor ($\tan\delta_L$) of $3.0\times10^{-2}$ or less;

(b) the magnetic toner having, in a dielectric dissipation factor ($\tan\delta$) thereof at a frequency of 100 kHz, a maximum value ($\tan\delta_H$) within the temperature range of from 60° C. to 140° C.; and the $\tan\delta_H$ and the $\tan\delta_L$ satisfying $(\tan\delta_H-\tan\delta_L)\leq3.0\times10^{-2}$.

Advantageous Effects of Invention

According to the present invention, a magnetic toner can be obtained which has superior uniformity in triboelectric charging between particles of the toner and also superior charging stability, and has stable developing performance without any dependence on service environments. A magnetic toner can also be obtained which may less cause any decrease in image density and any image defects such as fog and ghost.

Further features of the present invention will become apparent from the following description of exemplary embodiments with reference to the attached drawings.

DESCRIPTION OF EMBODIMENTS

Figure 1A:
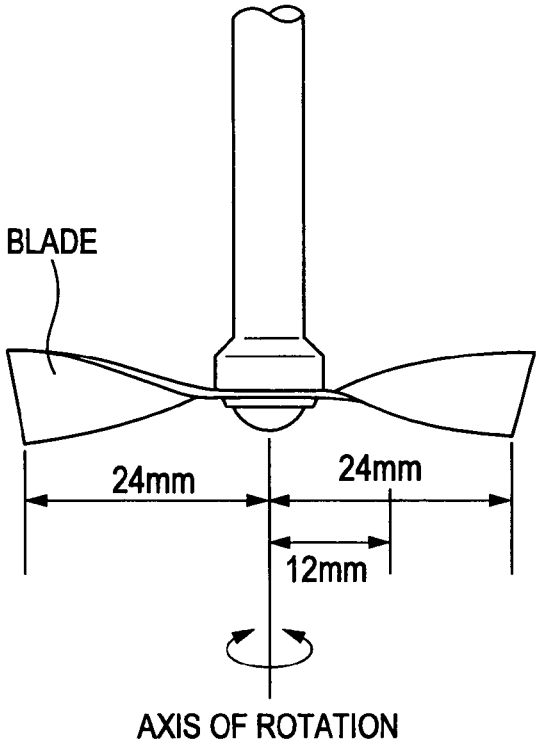
FIGS. 1A and 1B illustrate a measuring blade used for measuring the flow characteristics of a magnetic material.

The magnetic toner of the present invention is a magnetic toner having magnetic toner particles which have magnetic toner base particles containing at least a binder resin and a magnetic material, and an inorganic fine powder; and (a) having, at a frequency of 100 kHz and a temperature of 30° C., a dielectric loss factor ($\in''$) of from $2.5\times10^{-1}$ pF/m or more to $7.0\times10^{-1}$ pF/m or less and a dielectric dissipation factor ($\tan\delta_L$) of $3.0\times10^{-2}$ or less, and (b) having, in a dielectric dissipation factor ($\tan\delta$) thereof at a frequency of 100 kHz, a maximum value ($\tan\delta_H$) within the temperature range of from 60° C. to 140° C., where the $\tan\delta_H$ and the $\tan\delta_L$ satisfies the relationship of $(\tan\delta_H-\tan\delta_L)\leq3.0\times10^{-2}$.

The value of the dielectric loss factor ($\in''$) has conventionally been used as an index that represents the readiness of dissipation of electric charges (dielectric loss). It can be said that, the higher the dielectric loss factor ($\in''$) is, the more readily the electric charges dissipate and the more not easily the magnetic toner can cause charge-up. If, however, the value of the dielectric loss factor ($\in''$) is too high, the magnetic toner can not retain the electric charges in turn, inevitably resulting in a low developing performance.

The present inventors have discovered that the dielectric loss factor ($\in''$) of the magnetic toner at a frequency of 100 kHz and a temperature of 30° C. may be set within the range of from $2.5\times10^{-1}$ pF/m or more to $7.0\times10^{-1}$ pF/m or less and a dielectric dissipation factor ($\tan\delta_L$) of $3.0\times10^{-2}$ or less and this enables the magnetic toner to be kept from both charging up and leaking electric charges. Thus, the magnetic toner can attain a stable chargeability without any dependence on service environments.

Here, the reason why the frequency is set to be 100 kHz as a standard for measuring the dielectric loss factor ($\in''$) is that it is a frequency preferable for inspecting the state of dispersion of the magnetic material in toner particles. If it is a frequency lower than 100 kHz, the dielectric loss is so small as to make it difficult to find any change in the dielectric loss factor ($\in''$) of the magnetic toner. If on the other hand it is a frequency higher than 100 kHz, the difference in dielectric characteristics to be found when the temperature is changed is so small as to be undesirable. Also, the temperature 30° C. is temperature having been set assuming the temperature inside a process cartridge during image formation.

If the dielectric loss factor ($\in''$) is less than $2.5\times10^{-1}$ pF/m, the magnetic toner may so easily retain electric charges as to tend to cause the charge-up in a low-temperature and low-humidity environment. If the charge-up occurs greatly, fog and density decrease may occur at the initial stage of service.

Even if such image defects are not seen at the initial stage of service, fog and density decrease may occur where the magnetic toner comes to have further broader charge quantity distribution, e.g., after long-term service at which the selective development has come to take place, or after long-term leaving. In particular, where a fresh magnetic toner is replenished on the way of service and then has been left to stand for a while in the state that the magnetic toner inside a developing assembly has come to have broad charge quantity distribution, it may come about that the density decrease is seen on images reproduced thereafter or the fog occurs conspicuously thereon.

If the dielectric loss factor (∈") is more than $7.0\times10^{-1}$ pF/m, the magnetic toner may have a low charge retentivity, so that a magnetic toner having an insufficient charge uniformity or not having any electric charges may increase to come to cause fog. Even where any image defects are not seen at the initial stage of service, it may also come about that the magnetic toner inside a developing assembly comes to have broad charge quantity distribution after long-term service or after long-term leaving to cause fog. This phenomenon comes about conspicuously especially in a high-temperature and high-humidity environment, where the electric charges tend to leak.

In the magnetic toner, the dielectric loss factor (∈") may be controlled within the above range by controlling the state of presence of the magnetic material in the vicinity of toner particle surfaces. In order to make high the value of the dielectric loss factor (∈"), the magnetic material may be made present at toner particle surfaces or in the vicinity of toner particle surfaces. The magnetic material, which has a lower resistance than resins, may be much present at toner particle surfaces or in the vicinity of toner particle surfaces, and this enables the electric charges to dissipate appropriately. However, making the magnetic material bare to the toner particle surfaces is not preferable because the dielectric loss factor (∈") may come so excessively large as to make the electric charges leak conspicuously. In order to satisfy the dielectric loss factor (∈") in the present invention, the magnetic material may be made present at particle surface portions without making it bare to the toner particle surfaces. On the other hand, in order to lower the value of the dielectric loss factor (∈"), the magnetic material may be made present in a small quantity in toner particle surface layers, and the magnetic material may be dispersed throughout the interiors of toner particles (inside "individual" toner particles).

Further, in the present invention, in addition to the feature that the dielectric loss factor (∈") is within the above range, the magnetic toner has, at a frequency of 100 kHz and a temperature of 30° C., a dielectric dissipation factor (tan $\delta_L$) of $3.0\times10^{-2}$ or less, where the magnetic toner can have a high uniformity in triboelectric charging between toner particles themselves, and can enjoy quick rise of charging.

The dielectric dissipation factor (tan δ) is expressed as the value of dielectric loss factor (∈")/dielectric constant (∈'), and has conventionally been used as an index of dielectric characteristics. Where the dielectric dissipation factor (tan δ) is small, the magnetic toner may so readily undergo dielectric polarization as to be quickly and uniformly chargeable. Inasmuch as the dielectric dissipation factor (tan $\delta_L$) is within the range of $3.0\times10^{-2}$ or less in the present invention, image defects such as sleeve ghost can be made less occur afterwards even where the magnetic toner has lowered in charge quantity because, e.g., it has been left to stand in a high-temperature and high-humidity environment.

On the other hand, when the dielectric dissipation factor (tan $\delta_L$) is larger than $3.0\times10^{-2}$, the rise of charging may be so slow as to provide any uniform charge, and hence image defects may occur after the magnetic toner has been left to stand in a high-temperature and high-humidity environment. In particular, such image defects tend to occur where a fresh magnetic toner is replenished on the way of service and then has been left to stand for a while in the state that the magnetic toner inside a developing assembly has come to have broad charge quantity distribution and thereafter images are reproduced. There is a difference in charge quantity between the magnetic toner replenished and the existent magnetic toner, where any magnetic toner inferior in the rise of charging can not cancel such a difference in charge quantity to cause sleeve ghost.

In order to improve the chargeability of the magnetic toner, it is very important to control both the dielectric loss factor (∈") and the dielectric dissipation factor (tan $\delta_L$) of the magnetic toner. Even though the dielectric loss factor (∈") is within the above range, the uniformity in charging may come inferior to cause image defects depending on environments if the dielectric dissipation factor (tan $\delta_L$) is in a range beyond $3.0\times10^{-2}$. Oh the other hand, even though the dielectric dissipation factor (tan $\delta_L$) is $3.0\times10^{-2}$ or less, the charging may lack in stability to cause fog attendant on selective development if the dielectric loss factor (∈") is outside the above range.

The dielectric dissipation factor (tan δ) may be controlled by controlling the state of dispersion of the magnetic material in toner particles. Making the magnetic material dispersed scatteredly in toner particles without any agglomeration makes the dielectric polarization easily take place, and this can make the value of the dielectric dissipation factor (tan δ) small. On the other hand, making the magnetic material agglomerate to make the dielectric polarization not easily take place can make the value of the dielectric dissipation factor (tan δ) large. Accordingly, the magnetic material may be kept from agglomerating in the toner particles, and this enables the value of the dielectric dissipation factor to be $3.0\times10^{-2}$ or less, and enables the magnetic toner to be improved in charging uniformity.

The dielectric dissipation factor (tan δ) commonly has temperature dependence, where the present inventors have discovered that the uniformity in triboelectric charging between toner particles themselves can be more improved when, in the magnetic toner, it has a maximum value (tan $\delta_H$) within the temperature range of from 60° C. to 140° C. and the difference between the maximum value (tan $\delta_H$) and the dielectric dissipation factor (tan $\delta_L$) is within a specific range.

The value of the dielectric dissipation factor (tan δ) depends greatly on, besides the state of dispersion of materials, the composition (make-up) of a binder resin. The internal state of a resin changes with a rise in temperature, and hence the value of the dielectric dissipation factor (tan δ) also varies. Hence, the value of the dielectric dissipation factor (tan δ) may also be controlled by selecting the binder resin. For example, where a polyester resin is used as the binder resin, the value of (tan $\delta_H$−tan $\delta_L$) can be larger than where a styrene-acrylic resin is used.

It is important that the dielectric dissipation factor (tan δ) at a frequency of 100 kHz shows a maximum value (tan $\delta_H$) within the temperature range of from 60° C. to 140° C. and that the value of (tan $\delta_H$−tan $\delta_L$) satisfies the following relationship:

$$0<\tan\delta_H-\tan\delta_L\leq3.0\times10^{-2}.$$

Incidentally, in the case of a resin for toner that is required to melt at the time of fixing, its dielectric dissipation factor (tan δ) at a frequency of 100 kHz shows a maximum value commonly within the range of from 60° C. to 140° C.

It has been found that even a magnetic toner making use of a binder resin having the like maximum value (tan $\delta_H$) shows a different value depending on the state of dispersion of the magnetic material in toner particles. Where the magnetic material is present standing agglomerate, any magnetic toner has a larger maximum value (tan $\delta_H$). About the reason therefor, the present inventors consider it as stated below. Toners have a glass transition temperature (Tg) of less than 60° C. in many cases, where, at temperatures of 60° C. or more, the resin comes to soften to make toners come to have no particle boundaries. In the state the resin has softened, the magnetic material having stood present at a high density in the vicinity of toner particle surfaces comes to tend to again agglomerate. Those which are highly agglomerative among magnetic materials further agglomerate in the resin having come to soften, and this can be a factor that makes the maximum value (tan $\delta_H$) larger.

The fact that the value of (tan $\delta_H$−tan $\delta_L$) is small shows that the difference is small between dielectric characteristics of toner in the case when it is not influenced by particle boundaries at the time of high temperature (at the time of fixing) and dielectric characteristics of toner having particle boundaries at room temperature. Even where the microscopic dispersibility of the magnetic material in toner particles at room temperature is alike, agglomeration may take place where the influence of particle boundaries has been removed at a high temperature. In a magnetic toner in which such agglomeration of a magnetic material takes place at a high temperature, a large value of (tan $\delta_H$−tan $\delta_L$) may result.

According to studies made by the present inventors, the magnetic toner can especially be good in regard to the charging uniformity and quickness of charging when the value of (tan $\delta_H$−tan $\delta_L$) is $3.0\times10^{-2}$ or less. Even in environments especially severe for the charging, as in development performed at a high speed in a high-temperature and high-humidity environment, any non-uniformity in image density can be kept from coming.

In order to make the value of (tan $\delta_H$−tan $\delta_L$) small, it is preferable to further keep the magnetic material from its microscopic agglomeration so as to make the magnetic material stand scatteredly dispersed in toner particles to such an extent that the agglomeration no longer takes place even at the time of high temperature.

In the present invention, the dielectric loss factor (∈"), dielectric dissipation factor (tan $\delta_L$) and value of (tan $\delta_H$−tan $\delta_L$) of the magnetic toner are controlled to thereby achieve a magnetic toner having superior uniformity in charging and superior stability of charging in any environmental variations.

The magnetic material used in the present invention may further preferably have a total energy (TE) of from 500 mJ or more to 2,000 mJ or less at the time of a stirring speed of 100 rpm, as measured with a powder fluidity measuring instrument. The fluidity of the magnetic material is concerned with the dispersibility of the magnetic material in toner particles. Inasmuch as the magnetic material has a total energy (TE) of not more than 2,000 mJ, the magnetic material has so high fluidity that the dispersibility of the magnetic material in toner particles can highly be controlled with ease. The magnetic material having a high fluidity can be kept from agglomerating in the binder resin (monomer) and can well be dispersed.

The fluidity of the magnetic material is greatly influenced by hydrophobic treatment of magnetic material particle surfaces. The magnetic material having been subjected to hydrophobic treatment has less water adsorption than any untreated magnetic material, and hence can have a higher fluidity, so that its dispersibility in toner particles can be improved. Further, conditions for the hydrophobic treatment my be controlled, and this enables the magnetic material to be distributed in the vicinity of toner particle surfaces without making the magnetic material bare to the toner particle surfaces.

A magnetic iron oxide may also be used as the magnetic material, and may be subjected to hydrophobic treatment (surface treatment) after silicon has been made much present on magnetic iron oxide particle surfaces. This is preferable because the dispersibility of the magnetic material in toner particles is more improved. Making the silicon present on the magnetic iron oxide particle surfaces enables uniform hydrophobic treatment because the magnetic iron oxide particle surfaces can have higher affinity for a hydrophobic-treating agent (surface treating agent), and makes the magnetic material more improved in its fluidity. Further, the hydrophobic-treating agent may be hydrolyzed to make its reactivity higher. This brings its strong chemical combination with the magnetic iron oxide particle surfaces to enable more uniform hydrophobic treatment. Details on a method for the hydrophobic treatment of the magnetic material are described later.

Making the magnetic material have a large particle diameter makes its fluidity higher and its total energy (TE) smaller, and hence the magnetic material is improved in dispersibility. If, however, the magnetic material has too large particle diameter, it tends to come bare to toner particle surfaces, and hence it is preferable for the magnetic material to have a volume average particle diameter (Dv) of 0.40 μm or less.

On the other hand, making the magnetic material have a small particle diameter makes its fluidity lower to make the magnetic material tend to be present in toner particles in the state of microscopic agglomeration, and hence it is preferable for the magnetic material to have a volume average particle diameter (Dv) of 0.10 μm or more.

The fluidity of the magnetic material is greatly influenced by water adsorption of magnetic material particle surfaces. In the magnetic iron oxide, functional groups such as hydroxyl groups are present on the magnetic iron oxide particle surfaces, and these adsorb water to make the cause of a poor fluidity. Accordingly, it is very important to keep the water from such adsorption by modifying the functional groups chemically (by treating particle surfaces). Here, as a surface treating agent, a silane compound, a titanate compound, an aluminate compound or the like is commonly known in the art, and all these surface treating agents may be hydrolyzed so as to effect condensation reaction with hydroxyl groups present on the magnetic iron oxide particle surfaces, and this brings its strong chemical combination with the magnetic iron oxide particle surfaces to bring out hydrophobicity. In view of the uniformity of treatment, the silane compound may particularly preferably be used because it can be more kept from its self condensation after hydrolysis than the other compounds.

However, even a magnetic material having been subjected to surface treatment may still have a large water adsorption if treated non-uniformly, and such a magnetic material is not preferable because it may have a low fluidity. Studies made by the present inventors have revealed that, in such treated magnetic material, it may preferably have a water adsorption per unit area of 0.30 mg/m$^2$ or less. In such a case, the magnetic material is considered to stand especially well treated over its whole particle surfaces.

Further, it is preferable that silicon is present at a specific level on the magnetic iron oxide particle surfaces. In such a case, the magnetic iron oxide particle surfaces are improved in their affinity for the silane compound and the uniformity of their treatment with the silane compound is more improved, as so considered. As the level of silicon, the silicon having dissolved out up to the time that the magnetic iron oxide is dispersed in an aqueous hydrochloric acid solution and dissolved therein until the dissolution percentage of iron has come to 5% by mass based on the whole iron element contained in the magnetic iron oxide may preferably be in a level of from 0.05% by mass or more to 0.50% by mass or less, based on the mass of the magnetic iron oxide.

Here, refer to the dissolution percentage of the iron element of the magnetic iron oxide. That the iron element is in a dissolution percentage of 100% by mass is a state in which the magnetic iron oxide has completely dissolved, and means that, the closer to 100% by mass the numerical value is, the more the magnetic iron oxide has dissolved out. Therefore, it is considered that the level of an element where the iron element dissolves up to the dissolution percentage of 5% by mass shows the level of the element present on the magnetic iron oxide particle surfaces.

As the silane compound, which may preferably be used in the hydrophobic treatment of the magnetic material particle surfaces, a silane coupling agent is available, of which it is preferable to use an alkylalkoxysilane represented by the general formula (A) shown below, after it has been subjected to hydrolysis treatment. The hydrolysis of any alkoxysilane makes its terminals into OH groups, and hence the alkoxysilane can have a high affinity for the OH groups present on the magnetic material particle surfaces. This makes the treating agent readily adsorptive on untreated magnetic material particle surfaces, and hence the surfaces can sufficiently be covered therewith, so that any untreated portions may remain with difficulty.

$$R_mSiY_n \quad (A)$$

wherein R represents an alkoxyl group or a hydroxyl group; m represents an integer of 1 to 3; Y represents an alkyl group or a vinyl group, which alkyl group may have as a substituent a functional group such as an amino group, a hydroxyl group, an epoxy group, an acrylic group or a methacrylic group; and n represents an integer of 1 to 3, provided that m+n=4.

The alkylalkoxysilane represented by the general formula (A) may include, e.g., ethyltriethoxysilane, ethyltrimethoxysilane, diethyldiethoxysilane, diethyldimethoxysilane, triethylmethoxysilane, n-propyltriethoxysilane, n-propyltrimethoxysilane, isopropyltriethoxysilane, isopropyltrimethoxysilane, n-butyltrimethoxysilane, n-butyltriethoxysilane, isobutyltrimethoxysilane and isobutyltriethoxysilane.

Of these, from the viewpoint of providing the magnetic material with a high hydrophobicity, an alkyltrialkoxysilane represented by the following formula (B) may preferably be used.

$$C_pH_{2p+1}—Si—(OC_qH2_{q+1})_3 \quad (B)$$

wherein p represents an integer of 2 to 20, and q represents an integer of 1 to 3.

In the above formula, if p is smaller than 2, the compound can not provide the magnetic material with a sufficient hydrophobicity. If p is larger than 20, though hydrophobicity can be sufficient, the compound comes larger in steric hindrance as the longer carbon chain it has, and hence tends to be disadvantageous for uniform and dense treatment. In order to satisfy treatment uniformity and sufficient hydrophobicity, p may preferably be 4 or less, and particularly preferably 3 or 4. Where p is 3, the magnetic material can sufficiently be provided with hydrophobicity and at the same time the treating agent capable of being adsorbed per unit area is in so large a number of molecules that treated magnetic material particle surfaces can be more improved in their uniformity. Also, where p is 4, the treating agent on the treated magnetic material particle surfaces is maintained also at a high density. That is, it is preferable that p is 3 or 4, in view of achieving both the hydrophobicity and the uniformity in treatment, highly controlling the state of presence of the magnetic material in magnetic toner in producing the magnetic toner and enabling the magnetic material to be distributed in the vicinity of toner particle surfaces. If q is larger than 3, the alkyltrialkoxysilane may have a low reactivity to make it hard for the magnetic material to be made sufficiently hydrophobic. Accordingly, it is preferable to use an alkyltrialkoxysilane in which q represents an integer of 1 to 3 (much preferably an integer of 1 or 2).

In the case when the above silane coupling agent is used, the treatment may be carried out using it alone, or using a plurality of types in combination. In using a plurality of types in combination, the treatment may be carried out using the respective coupling agents separately, or the treatment may be carried out using them simultaneously.

In order to improve the uniformity of surface treatment, the silane compound may preferably have a hydrolysis percentage of 50% or more, and much preferably 70% or more. The silane compound having a hydrolysis percentage of 50% or more is adsorbed on the magnetic iron oxide particle surfaces through hydrogen bonding with hydroxyl groups or the like thereon, and this may be heated and then dehydrated to form strong chemical combination between the both. On the other hand, any silane compound not subjected to hydrolysis treatment may unwantedly volatilize from the magnetic iron oxide particle surfaces when heated at approximately from 100° C. to 120° C. at the time of surface treatment. For such a reason, the silane compound is subjected to the hydrolysis treatment, and this enables the magnetic iron oxide particle surfaces to be much treated with such a treating agent to make the uniformity of surface treatment more improved. Here, the hydrolysis percentage of the silane compound is the value found where a state in which the alkoxysilane has completely hydrolyzed is defined to be hydrolysis percentage=100%, and the proportion of any residual alkoxyl groups is subtracted therefrom.

The hydrolysis of the alkoxysilane may be carried out by, e.g. the following method.

In general, the lower the pH is and the higher the liquid temperature is, the more readily the alkoxysilane may be hydrolyzed but at the same time the more it also tends to undergo self condensation. However, where a dispersion apparatus capable of providing a high shear is used (e.g., a dispersing blade is used), the area of contact between the alkoxysilane and the water can be made larger to accelerate the hydrolysis well efficiently.

More specifically, the alkoxysilane may slowly be introduced into an aqueous solution or mixed solvent of an alcohol and water the pH of which has been adjusted to 4 or more to 6 or less, and the mixture obtained may be stirred by means of, e.g., a dispersing blade to carry out uniform dispersion. During this, the dispersion being formed may preferably have a liquid temperature of from 35° C. or more to 50° C. or less. Under such conditions, the alkoxysilane can be hydrolyzed at a high percentage and simultaneously be kept from undergoing self condensation.

The treated magnetic material may be produced by, e.g., the following method.

First, to an aqueous ferrous salt solution, an alkali such as sodium hydroxide is added in an equivalent weight, or more than equivalent weight, with respect to the iron component to prepare an aqueous solution containing ferrous hydroxide. Into the aqueous solution thus prepared, air is blown while the pH of the aqueous solution is maintained at pH 7.0 or more, and the ferrous hydroxide is made to undergo oxidation reaction while the aqueous solution is heated at 70° C. or more to firstly form seed crystals serving as cores of magnetic iron oxide particles.

Next, to a slurry-like liquid containing the seed crystals, an aqueous solution containing ferrous sulfate in about one equivalent weight on the basis of the quantity of the alkali previously added is added. The reaction of the ferrous hydroxide is continued while the pH of the liquid is maintained at 5.0 or more to 10.0 or less and air is blown thereinto, to cause magnetic iron oxide particles to grow about the seed crystals as cores.

The particle shape and magnetic properties of the magnetic material may be controlled by selecting any desired pH, reaction temperature, air blow rate and stirring conditions. The lower the reaction temperature is and the more the air is blown, the more easily the magnetic material is made into fine particles. Also, with progress of oxidation reaction, the pH of the liquid comes to shift to acid side, but the pH of the liquid may preferably be so adjusted as not to be made less than 5.0. After the oxidation reaction has been completed, a silicon source such as sodium silicate is added, and the pH of the liquid is adjusted to 5.0 or, more to 8.0 or less. By doing so, coat layers of silicon are formed on the magnetic iron oxide particle surfaces. The magnetic iron oxide particles thus obtained may be filtered, followed by washing and then drying all by conventional methods to obtain the magnetic iron oxide. Here, the amount of the silicon source such as sodium silicate to be added after the oxidation reaction has been completed may be regulated to control the level of the silicon element present on the magnetic iron oxide particle surfaces.

Next, the surface treatment with the silane compound is carried out on the above magnetic iron oxide particle surfaces. The surface treatment includes a dry process and a wet process. Where the surface treatment is carried out by the wet process, after the oxidation reaction has been completed, the magnetic material having been dried is re-dispersed in an aqueous medium, or, after the oxidation reaction has been completed, the magnetic material obtained by washing and filtration may be re-dispersed in another aqueous medium without drying. Stated specifically, the silane compound alkoxysilane is added while the re-dispersed product is thoroughly stirred and, after the hydrolysis, the temperature of the resultant dispersion is raised or, after the hydrolysis, the pH of the resultant dispersion is adjusted to the alkaline side to carry out the hydrophobic treatment.

In both processes of the dry process and the wet process, in the step of surface treatment, the silane compound is adsorbed on the magnetic material particle surfaces in the manner of hydrogen bonding, and thereafter the step of drying is carried out to make dehydration condensation reaction proceed, to secure strong bonding.

The treatment with the silane compound may preferably be carried out by the dry process, in which it is carried out in a gaseous phase. About the reason therefor, the present inventors consider it in the following way. In the dry process, the water is present only in a small quantity in the reaction system, and hence any hydrophobic groups contained in the silane compound and the water may form hydrogen bonds with difficulty. Thus, compared with the wet process, in which the water is present in a large quantity, the hydrogen bonding with the magnetic material particle surfaces can be in so high a percentage as to enable more uniform and efficient hydrophobic treatment with the silane compound.

A specific dry process is exemplified next. The dry process includes a method of processing in which the treating agent is volatilized to make it adhere to the magnetic material base, a method in which the treating agent is sprayed on the magnetic material base by using an apparatus such as a spray dryer, and a method in which the treating agent and the magnetic material base are agitated under application of a shear by using an apparatus such as Henschel mixer. In particular, a method is simple and preferred in which a hydrolysate of the silane compound is dropwise added to the untreated magnetic material while it is agitated and the mixture obtained is further agitated, by using an apparatus such as Henschel mixer. A magnetic material on the particle surfaces of which the hydrolysate of the silane compound stands adsorbed is obtained and thereafter heated to make the dehydration condensation reaction proceed, thus the magnetic material having been hydrophobic-treated can be obtained.

In the present invention, any alkali metal and/or alkaline earth metal having dissolved out up to the time that the magnetic iron oxide is dispersed in an aqueous hydrochloric acid solution and dissolved therein until the dissolution percentage of the iron element has come to 5% by mass based on the whole iron element contained in the magnetic iron oxide may preferably be in a total level of 0.010% by mass or less, based on the mass of the magnetic iron oxide. That such a metal is substantially or completely not present on the magnetic iron oxide particle surfaces is very preferable because the treatment with the silane compound can be more uniform. The present inventors consider the reason therefor to be the following: As described thus far, it is preferable to be the magnetic iron oxide in which the hydrogen bonding is made to take place between the hydroxyl groups or silanol groups and the silane compound on the magnetic iron oxide particle surfaces and thereafter dehydration is effected to provide their chemical combination with each other. If, however, the alkali metal and/or alkaline earth metal is/are much present on the magnetic iron oxide particle surfaces, these metallic elements may coordinate with the hydroxyl groups or silanol groups to hinder their hydrogen bonding with the silane compound unwantedly. This is considered due to the fact that the hydroxyl groups and silanol groups are anions, whereas the alkali metal and alkaline earth metal are cations, and hence the latter tends to coordinate with the hydroxyl groups or silanol groups electrically. This may inevitably damage the uniformity in treatment with the silane compound.

The presence level of the alkali metal and/or alkaline earth metal on the magnetic iron oxide particle surfaces may be controlled by making ion exchange with an ion exchange resin after the magnetic iron oxide has been produced.

Stated specifically, the magnetic iron oxide produced in an aqueous system as described above is filtered and washed and thereafter again introduced into water to make re-slurry. Into the slurry thus obtained, the ion exchange resin is introduced, followed by stirring to remove the alkali metal and/or alkaline earth metal. Thereafter, the ion exchange resin may be filtered with a mesh to remove the ion exchange resin. Here, the total level of the alkali metal and/or alkaline earth metal present on the magnetic iron oxide particle surfaces may be controlled by selecting the time for stirring and the amount of the ion exchange resin to be introduced.

The magnetic toner of the present invention may be produced by any conventionally known method. In order to obtain the magnetic toner that satisfies the physical properties specified in the present invention, a method of production in an aqueous medium is suited.

As the method of production in an aqueous medium, it may include dispersion polymerization, association agglomeration, solution suspension and suspension polymerization. The magnetic toner of the present invention may be produced by suspension polymerization, and this is particularly preferable because the physical properties preferable in the present invention can be satisfied with ease. In the suspension polymerization, a polymerizable monomer(s) and the magnetic material (and further optionally a polymerization initiator, a cross-linking agent, a charge control agent and other additives) are uniformly dissolved or dispersed to obtain a polymerizable monomer composition. Thereafter, the polymerizable monomer composition is added into a continuous phase (e.g., an aqueous phase) containing a dispersion stabilizer and dispersed therein by means of a suitable stirrer to carry out polymerization reaction to obtain toner particles (herein refer to "toner base particles" when applicable as toner particles standing before any external additive is added thereto) having the desired particle diameters. In the toner particles obtained by this suspension polymerization, the individual toner particles stand uniform in a substantially spherical shape, and hence the uniformity in charge quantity distribution as aimed in the present invention can be made higher.

Components contained in the magnetic toner of the present invention are described below.

The magnetic toner of the present invention contains a binder resin. The binder resin used in the magnetic toner of the present invention may include homopolymers of styrene and derivatives thereof, such as polystyrene and polyvinyltoluene; styrene copolymers such as a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-dimethylaminoethyl acrylate copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer, a styrene-maleic acid copolymer and a styrene-maleate copolymer; and polymethyl methacrylate, polybutyl methacrylate, polyvinyl acetate, polyethylene, polypropylene, polyvinyl butyral, silicone resins, polyester resins, polyamide resins, epoxy resins and polyacrylic acid resins, any of which may be used. Any of these may be used alone or in combination of two or more types. Of these, styrene-acrylic resins composed of copolymers of styrene with acrylic monomers are preferred in view of developing performance of the magnetic toner.

The magnetic toner of the present invention may optionally be mixed with a charge control agent in order to improve charging performance. As the charge control agent, any known charge control agent may be used. In particular, charge control agents which can give speedy charging and also can maintain a constant charge quantity stably are preferred. Further, where the toner particles are directly produced by polymerization as detailed later, it is particularly preferable to use charge control agents having a low polymerization inhibitory action and being substantially free of any solubilizate to an aqueous dispersion medium. Among such charge control agents, they may specifically include, as negative charge control agents, metal compounds of aromatic carboxylic acids such as salicylic acid, alkylsalicylic acids, dialkylsalicylic acids, naphthoic acid and dicarboxylic acids; metal salts or metal complexes of azo dyes or azo pigments; polymers or copolymers having a sulfonic acid group, a sulfonic salt group or a sulfonic ester group; and boron compounds, urea compounds, silicon compounds, and carixarene. As positive charge control agents, they may include quaternary ammonium salts, polymeric compounds having such a quaternary ammonium salt in the side chain, guanidine compounds, Nigrosine compounds and imidazole compounds.

In particular, the polymers or copolymers having a sulfonic acid group, a sulfonic salt group or a sulfonic ester group are preferred because they have so high a polarity as to be easily made present on toner particle surfaces when used in combination with the suspension polymerization.

As a method for incorporating the magnetic toner with the charge control agent, a method is available in which it is internally added to the toner particles. In the case when the magnetic toner is produced by suspension polymerization, commonly available is a method in which the charge control agent is added to a polymerizable monomer composition before its granulation. Also, a polymerizable monomer in which the charge control agent has been dissolved or suspended may be added in the midst of forming oil droplets in water to effect polymerization, or after the polymerization, to carry out seed polymerization so as to cover magnetic toner particle surfaces uniformly. Still also, the charge control agent are added to the toner particles and then these may be mixed and agitated under application of a shear to incorporate it into magnetic toner particle surface portions.

The magnetic toner of the present invention may preferably have a weight average particle diameter (D4) of from 3 μm or more to 10 μm or less, and much preferably from 4 μm or more to 9 μm or less, from the viewpoint of enjoying high image quality.

The magnetic toner of the present invention may preferably have a glass transition temperature (Tg) of from 40.0° C. or more to 70.0° C. or less, from the viewpoint of taking balance between fixing performance, storage stability and developing performance.

The magnetic toner of the present invention may preferably have a core-shell structure in order to more improve running developing performance. This is because, as having shell layers, the magnetic toner can have uniform particle surface properties, be improved in fluidity and also have uniform charging performance.

In the shell layers, it is preferable to use an amorphous high-molecular material, which may preferably have an acid value of from 5.0 mgKOH/g or more to 20.0 mgKOH/g or less, from the viewpoint of the stability of charging. The use of such high-molecular material shells makes cores uniformly covered therewith and hence enables any low-melting substance such as wax to be kept from coming to, e.g., exude to toner particle surfaces, even during long-term storage.

As a specific method for forming the shells, a method is available in which fine particles for shells are embedded in core particles. In the case when the magnetic toner is produced in an aqueous medium, the fine particles for shells may be made to adhere to the core particles. Also, in the case of solution suspension or suspension polymerization, a hydrophilic resin may be used as the high-molecular material for shells, and this enables the shells to be formed by utilizing the hydrophilicity of the resin to make such a high-molecular material localized at interfaces with water, i.e., in the vicinity of the magnetic toner particle surfaces. Further, the shells may also be formed by what is called seed polymerization, according to which a monomer is made to swell on core particle surfaces and then polymerized.

As the resin for forming the shells, an amorphous polyester resin is particularly preferable because the above effect can greatly be brought out.

As the amorphous polyester resin, any conventional one constituted of an alcohol component and an acid component may be used. About both the components, they are exemplified below.

As the alcohol component, it may include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, cyclohexane dimethanol, butenediol, octenediol, cyclohexene dimethanol, hydrogenated bisphenol A and bisphenol derivatives.

As a dibasic carboxylic acid, it may include benzene dicarboxylic acids or anhydrides thereof, such as phthalic acid, terephthalic acid, isophthalic acid and phthalic anhydride; alkyldicarboxylic acids such as succinic acid, adipic acid, sebacic acid and azelaic acid, or anhydrides thereof, or further succinic acid or its anhydride substituted with an alkenyl group having 6 to 18 carbon atoms; and unsaturated dicarboxylic acids such as fumaric acid, maleic acid, citraconic acid and itaconic acid, or anhydrides thereof.

The alcohol component may further include, as a polyhydric alcohol component, polyhydric alcohols such as glycerol, pentaerythritol, sorbitol, sorbitan, and oxyakylene ethers of novolak phenol resins. As the acid component, it may include as a polybasic acid component polycarboxylic acids such as trimellitic acid, pyromellitic acid, 1,2,3,4-butanetetracarboxylic acid, benzophenonetetracarboxylic acid and anhydrides thereof.

In particular, as the alcohol component, an amorphous polyester resin synthesized by using an alkylene oxide addition product of the bisphenol A is preferred because it is superior in view of charge characteristics and environmental stability. In this case, the alkylene oxide may preferably have an average addition molar number of from 2.0 moles or more to 10.0 moles or less.

The high-molecular material that forms the shells may also have a number average molecular weight (Mn) of from 2,500 or more to 20,000 or less.

In producing the magnetic toner particles according to the present invention, the polymerizable monomer constituting the polymerizable monomer composition may include the following: Styrene monomers such as styrene, o-methylstyrene, m-methylstyrene, p-methylstyrene, p-methoxystyrene and p-ethylstyrene; acrylic esters such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate and phenyl acrylate; methacrylic esters such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; and other monomers such as acrylonitrile, methacrylonitrile and acrylamides. Any of these monomers may be used alone or in the form of a mixture of two or more types. Of the foregoing monomers, styrene or a styrene derivative may preferably be used alone or in the form of a mixture with other monomer(s). This is preferable in view of developing performance and running performance of the magnetic toner.

As the polymerization initiator used when the magnetic toner particles are produced by the method in which the polymerizable monomer is polymerized in an aqueous medium, preferred is one having a half-life of from 0.5 hour or more to 30.0 hours or less. The polymerization initiator may also be used in its addition in an amount of from 0.5 part by mass or more to 20.0 parts by mass or less, based on 100 parts by mass of the polymerizable monomer. As a specific polymerization initiator, it may include azo type or diazo type polymerization initiators such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile and azobisisobutyronitrile; and peroxide type polymerization initiators such as benzoyl peroxide, methyl ethyl ketone peroxide, diisopropyl peroxycarbonate, cumene hydroperoxide, 2,4-dichlorobenzoyl peroxide, lauroyl peroxide, dilauroyl peroxide, t-butyl peroxy-2-ethylhexanoate and t-butyl peroxypivarate.

In producing the magnetic toner particles, a cross-linking agent may optionally be added, which may preferably be added in an amount of from 0.01 part by mass or more to 10.00 parts by mass or less, based on 100 parts by mass of the polymerizable monomer. Here, as the cross-linking agent, compounds chiefly having at least two polymerizable double bonds may be used. It may include, e.g., aromatic divinyl compounds such as divinyl benzene and divinyl naphthalene; carboxylic acid esters having two double bonds, such as ethylene glycol diacrylate, ethylene glycol dimethacrylate and 1,3-butanediol dimethacrylate; divinyl compounds such as divinyl aniline, divinyl ether, divinyl sulfide and divinyl sulfone; and compounds having at least three vinyl groups; any of which may be used alone or in the form of a mixture of two or more types.

In the case of producing the magnetic toner particles by polymerization, a polymerizable monomer composition prepared by adding the above toner-composing materials appropriately and dissolving or dispersing them uniformly is suspended in an aqueous medium containing a dispersion stabilizer. Here, a high-speed dispersion machine such as a high-speed stirrer or an ultrasonic dispersion machine may be used to make the toner particles have the desired particle size at a stretch. This can more readily make the resultant toner particles have a sharp particle size distribution. As the time at which the polymerization initiator is added, it may be added simultaneously when other additives are added to the polymerizable monomer, or may be mixed immediately before they are suspended in the aqueous medium. Also, a polymerization initiator having been dissolved in the polymerizable monomer or in a solvent may be added immediately after granulation and before the polymerization reaction is initiated.

After granulation, agitation may be carried out using a usual agitator in such an extent that the state of particles is maintained and also the particles can be prevented from floating and settling.

When the magnetic toner particles are produced by polymerization, any of known surface-active agents or organic or inorganic dispersants may be used as a dispersion stabilizer. In particular, the inorganic dispersants may preferably be used because they may hardly cause any harmful ultrafine powder and they attain dispersion stability on account of their steric hindrance. Hence, even when reaction temperature is changed, they may hardly loose the stability, can be washed with ease and may hardly adversely affect toners, and hence they may preferably be used. As examples of such inorganic dispersants, they may include phosphoric acid polyvalent metal salts such as tricalcium phosphate, magnesium phosphate, aluminum phosphate, zinc phosphate and hydroxyl apatite; carbonates such as calcium carbonate and magnesium carbonate; inorganic salts such as calcium metasilicate, calcium sulfate and barium sulfate; and inorganic compounds such as calcium hydroxide, magnesium hydroxide and aluminum hydroxide. Any of these inorganic dispersants may preferably be used in an amount of from 0.20 part by mass or more to 20.00 parts by mass or less, based on 100 parts by mass of the polymerizable monomer. The above dispersion stabilizer may also be used alone or in combination of two or more types.

In the step of polymerizing the polymerizable monomer, the polymerization may be carried out at a polymerization temperature set at 40° C. or more, and commonly at a temperature of from 50° C. or more to 90° C. or less.

After the above step has been completed, the polymerization toner particles obtained may be subjected to filtration, washing and drying by conventional methods to obtain the magnetic toner particles. The magnetic toner particles thus obtained may optionally be mixed with an inorganic fine powder described later, to make it adhere to the surfaces of the magnetic toner particles. A classification step may also be inserted (before mixing with the inorganic fine powder) so as to remove coarse powder and fine powder present mixedly with the magnetic toner particles.

The magnetic toner of the present invention is one having the inorganic fine powder. As the inorganic fine powder, silica, titanium oxide or alumina powder may be used. A composite powder of silica and any other metal oxide may also be used.

In the present invention, the inorganic fine powder may preferably be one having been hydrophobic-treated. This is preferable because the magnetic toner can be improved in its environmental stability.

In the magnetic toner of the present invention, as long as it is substantially not adversely affected, other additives may further be used, which may include, e.g., lubricant powders such as polyethylene fluoride powder, zinc stearate powder and polyvinylidene fluoride powder; abrasives such as cerium oxide powder, silicon carbide powder and strontium titanate powder; fluidity-providing agents such as titanium oxide powder and aluminum oxide powder; and anti-caking agents; as well as reverse-polarity organic fine particles or inorganic fine particles, which may also be used in a small quantity as a developability improver. These additives may also be used after hydrophobic treatment of their particle surfaces.

Methods for measuring the respective physical properties according to the magnetic toner of the present invention are described next.

(1) Dielectric loss factor (∈") and dielectric dissipation factor (tan δ) of toner:

The dielectric characteristics of the magnetic toner according to the present invention are measured by the following method.

Using 4284A Precision LCR Meter (manufactured by Hewlett-Packard Co.), a complex dielectric constant at a frequency of 100 kHz is measured after correction at frequencies of 1 kHz and 1 MHz to calculate the dielectric loss factor (∈") and the dielectric dissipation factor (tan δ). Stated specifically, the magnetic toner is weighed in an amount of 1.0 g, which is then molded into a disk-like measuring sample of 25 mm in diameter and 1 mm or less (preferably 0.5 to 0.9 mm) in thickness under application of a load of 19,600 kPa (200 kg/cm$^2$) over a period of 2 minutes. This measuring sample is fitted to ARES (manufactured by Rheometric Scientific F.E. Ltd.) fitted with a dielectric constant measuring jig (electrode) of 25 mm in diameter, and then heated to a temperature of 80° C. so as to be melted and fixed thereto. Thereafter, this sample is cooled to a temperature of 25° C., and then heated to 150° C. keeping the frequency of 100 kHz constant in the state that a load of 0.49 N (50 g) is applied to the sample, and while taking in the measured values at intervals of 15 seconds at a heating rate of 2° C. per minute. From the measured values found, the dielectric loss factor (∈"), dielectric dissipation factor (tan $\delta_L$) and dielectric dissipation factor (tan $\delta_H$) are determined.

(2) Total Energy (TE) of Magnetic Material:

In the magnetic material used in the present invention, the total energy (TE) at the time the stirring speed is 100 rpm is measured with a powder fluidity analyzer Powder Rheometer FT-4 (manufactured by Freeman Technology Ltd.) (hereinafter often simply "FT-4").

Figure 1B:
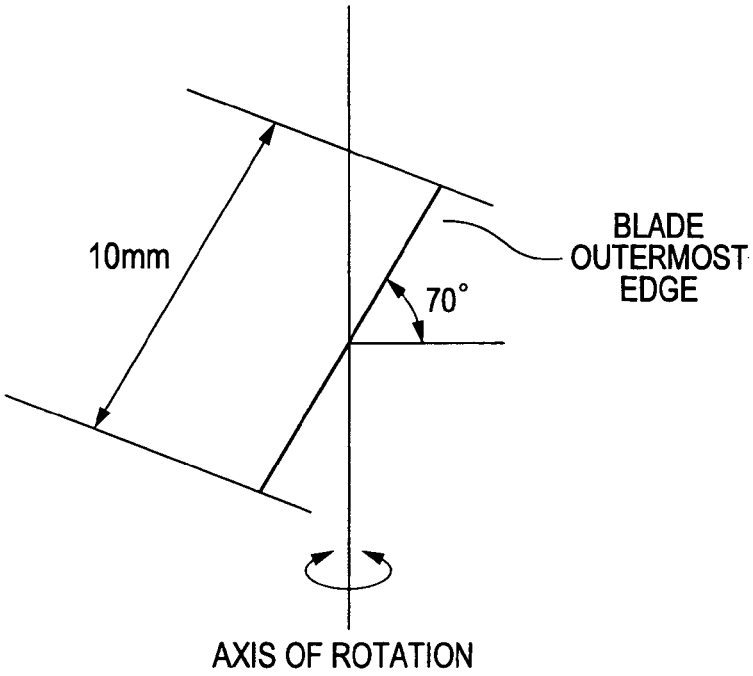

Stated specifically, it is measured by the following operation. Here, in all operation, a blade of 48 mm in diameter which is exclusively used for the measurement with FT-4 is used as a propeller type blade [see FIGS. 1A and 1B; one made of SUS stainless steel is used (model number: C210) in which, at the center of a blade plate of 48 mm×10 mm, an axis of rotation exists in the normal direction, and the blade plate is counterclockwise gently twisted in such a way that its both outermost edges (the part of 24 mm each from the axis of rotation) are 70° and the part of 12 mm each from the axis of rotation are 35°; hereinafter often simply "blade"].

A magnetic material having been left to stand for at least 3 days in an environment of 23° C. and 60% RH is put into a cylindrical split container of 50 mm in diameter and 160 ml in volume which is exclusively used for the measurement with FT-4 (model number: C203; 82 mm in height from the bottom of the container to the split part; hereinafter often simply "container"), up to its height of 95 mm from bottom of the container to thereby form a powder layer of the magnetic material.

(2-1) Conditioning Operation:

(a) In the rotational direction that is clockwise with respect to the powder layer surface (the direction where the powder layer is made to loosen by the rotation of the blade), the rotational speed of the blade is set to a peripheral speed of 60 mm/sec at the outermost edges of the blade and the velocity of its penetration into the powder layer in its vertical direction is set to a speed that makes 5 degrees for the angle formed between the locus the blade on move draws at its outermost edges and the powder layer surface (hereinafter often simply "formed angle"), where the blade is made to penetrate into the powder layer from its surface up to a position of 10 mm from the bottom of the powder layer. Thereafter, in the rotational direction that is clockwise with respect to the powder layer surface, the blade is so operated that it is made to penetrate into the powder layer up to a position of 1 mm from the bottom thereof in the state that its rotational speed is 60 mm/sec and the velocity of its penetration into the powder layer in its vertical direction is set to a speed that makes 2 degrees for the formed angle, and thereafter, in the rotational direction that is clockwise with respect to the powder layer surface, the blade is moved and pulled out up to a position of 100 mm from the bottom of the powder layer (i.e., 5 mm above from the powder layer surface) in the state that its rotational speed is 60 mm/sec and the velocity at which it is pulled out from the powder layer is set to a speed that makes 5 degrees for the formed angle. After the blade has completely been pulled out, it is alternately clockwise and anticlockwise rotated with a small movement to thereby shake off any toner adhering to the blade.

(b) A series of operation for the above (2-1)-(a) is made five times to thereby remove any air standing caught in the powder layer to form a stable powder layer.

(2-2) Splitting Operation:

The powder layer is leveled at the split part of a cell which is exclusively used for the measurement with the above FT-4, to remove any toner at the upper part of the powder layer to thereby form a powder layer having the same volume.

(2-3) Measurement Operation:

(i) Measurement of TE (a) Operation for the above (2-1)-(a) is made once.

Next, in the rotational direction that is anticlockwise with respect to the powder layer surface (the direction where the powder layer is forced by the rotation of the blade), the rotational speed of the blade is set to a speed of 100 mm/sec and the velocity of its penetration into the powder layer in its vertical direction is set to a speed that makes 5 degrees for the formed angle, where the blade is made to penetrate into the powder layer up to a position of 10 mm from the bottom thereof. Thereafter, in the rotational direction that is clockwise with respect to the powder layer surface, the blade is so operated that it is made to penetrate into the powder layer up to a position of 1 mm from the bottom thereof in the state that its rotational speed is 60 mm/sec and the velocity of its penetration into the powder layer in its vertical direction is set to a speed that makes 2 degrees for the formed angle. Thereafter, in the rotational direction that is clockwise with respect to the powder layer surface, the blade is pulled out up to a position of 100 mm from the bottom of the powder layer in the state that its rotational speed is 60 mm/sec and the velocity at which it is pulled out from the powder layer is set to a speed that makes 5 degrees for the formed angle. After the blade has completely been pulled out, it is alternately clockwise and anticlockwise rotated with a small movement to thereby shake off any toner adhering to the blade.

(b) The operation for penetration and pull-out of the blade in the above (2-3)-(a) is repeatedly made seven times, and the measurement is started at the seventh operation at a blade rotational speed of 100 mm/sec and from a position of 100 mm from the bottom of the powder layer. The total sum of rotational torque and vertical load obtained when the blade is made to penetrate into the powder layer up to a position of 10 mm from the bottom thereof is taken as the TE.

(3) Volume Average Particle Diameter (Dv) of Magnetic Material:

The magnetic material to be observed is well dispersed in epoxy resin, followed by curing for 2 days in an environment of temperature 40° C. to obtain a cured product. The cured product obtained is cut out in slices by means of a microtome to prepare a sample, where the particle diameter of 100 particles of magnetic iron oxide in the visual field is measure on a photograph taken at 40,000 magnifications using a transmission electron microscope (TEM). Then, the volume-average particle diameter (Dv) is calculated on the basis of circle-equivalent diameter equal to the particle projected area of the magnetic material.

(4) BET Specific Surface Area of Magnetic Material:

The BET specific surface area of the magnetic material is measured according to JIS 28830 (2001). A specific measuring method is as follows:

As a measuring instrument, an automatic specific surface area/pore distribution measuring instrument "TriStar 3000" (manufactured by Shimadzu Corporation) is used, which employs as a measuring system a gas adsorption method based on a constant-volume method. The setting of conditions for the measurement and the analysis of measured data are performed by using software "TriStar 3000 Version 4.00" attached to the instrument for its exclusive use. A vacuum pump, a nitrogen gas feed pipe and a helium gas feed pipe are also connected to the instrument. Nitrogen gas is used as adsorption gas, and the value calculated by the BET multipoint method is taken as the BET specific surface area referred to in the present invention.

The measurement with this instrument is made according to "TriStar 3000 Manual V4.0" attached to the instrument. Stated specifically, the measurement is made by the following procedure.

The tare weight of a sample cell (stem diameter: ⅜ inches; volume: about 5 ml) for exclusive use, made of glass, which has thoroughly been washed and then dried is precisely weighed. Then, about 3.0 g of the magnetic material (magnetic iron oxide) is put into this sample cell by using a filter cartridge.

The sample cell into which the magnetic iron oxide has been put is set in a "pretreatment instrument VacuPrep 061 (manufactured by Shimadzu Corporation)", and vacuum deaeration is continued at 23° C. for about 10 hours. Here, during the vacuum deaeration, the deaeration is gradually carried out while controlling a valve so that the magnetic material magnetic iron oxide may not be sucked by a vacuum pump. The pressure inside the cell lowers gradually with the deaeration, and finally comes to be about 0.4 Pa (about 3 milliTorr). After the vacuum deaeration has been completed, nitrogen gas is gradually flowed into the sample cell to return its interior to the atmosphere, where the sample cell is detached from the pretreatment instrument. Then, the mass of this the sample cell is precisely weighed, and the accurate mass of the magnetic iron oxide is calculated from a difference from the tare weight of the sample cell. Here, on this occasion, the sample cell is kept covered up with a rubber stopper so that the magnetic iron oxide in the sample cell may not be contaminated with water and the like.

Next, the above sample cell holding the magnetic iron oxide is fitted, at its stem part, with an "isothermal jacket" for exclusive use. Then, a filler rod for exclusive use is inserted into this sample cell, and this sample cell is set in an analytical port of the instrument. Here, the isothermal jacket is a cylindrical member the inner surface of which is made up of a porous material and the outer surface of which is made up of an impermeable material, which is capable of sucking up liquid nitrogen to a given level by capillarity.

Subsequently, the free space of the sample cell, inclusive of instruments connected thereto, is measured. The volume of the sample cell is measured by using helium gas at 23° C. and then the volume of the sample cell standing after it has been cooled with liquid nitrogen is likewise measured by using helium gas, where the free space is calculated by converting a difference between these volumes. Saturated vapor pressure Po (Pa) of nitrogen is also separately automatically measured by using a Po tube built in the instrument.

Next, the interior of the sample cell is brought to vacuum deaeration, and thereafter this sample cell is cooled with liquid nitrogen while continuing the vacuum deaeration. Thereafter, nitrogen gas is stepwise introduced into the sample cell to make nitrogen molecules adsorbed on the magnetic iron oxide. On this occasion, an absorption isotherm is obtained by measuring equilibrium pressure P (Pa) at any time, and hence this absorption isotherm is converted into a BET plot. Here, points of relative pressure Pr at which the data are to be collected are set at 6 points in total, which are 0.05, 0.10, 0.15, 0.20, 0.25 and 0.30. For the measured data obtained, a straight line is drawn by the method of least squares, and Vm is calculated from the slant and intercept of the straight line. Further, the value of this Vm is used to calculate the BET specific surface area of the magnetic iron oxide as described above.

(5) Iron Element Dissolution Percentage, and Silicon, Alkali Metal and Alkaline Earth Metal Content:

In the present invention, the dissolution percentage of the iron element of magnetic iron oxide and the content of metallic elements other than the iron element with respect to the iron element dissolution percentage may be determined by a method as described below. Stated specifically, 3 liters of deionized water is put into a 5-liter beaker, and is heated with a water bath so as to come to 50° C. To this water heated, 25 g of the magnetic material base is added and these are stirred. Next, guaranteed hydrochloric acid is added thereto to prepare an aqueous 3 mol/liter hydrochloric acid solution, and then the magnetic iron oxide is dissolved therein. In the course of from the starting of its dissolution until it has come dissolved completely to become transparent, the solution being formed is sampled tens of times, and respective samples obtained by such sampling are immediately filtered with a membrane filter of 0.1 μm in mesh opening to collect filtrates. The filtrates were each put to plasma emission spectroscopy (ICP, inductively coupled plasma) to quantitatively determine the iron element and the metallic elements other than the iron element, and then the iron element dissolution percentage is found for each sample according to the following expression.

Iron element dissolution percentage=(iron element concentration in sample/iron element concentration when dissolved completely)×100.

The content of silicon, alkali metal and alkaline earth metal in each sample is also determined, and the content of silicon, alkali metal and alkaline earth metal present until the iron element dissolution percentage come to 5% is determined from the relationship between the iron element dissolution percentage obtained by the above measurement and the content of elements detected during that measurement.

(6) Water Adsorption Per Unit Area of Treated Magnetic Material:

The BET specific surface area and water adsorption of the treated magnetic material used are measured, and the water adsorption per unit area of the treated magnetic material in the present invention is calculated by using numerical values thus found.

First, the treated magnetic material is left to stand for 72 hours in an environment of temperature 30° C. and humidity 80%, and thereafter the water adsorption of the treated magnetic material is measured with water content measuring instruments manufacture by Hiranuma Sangyo Co., Ltd. Stated specifically, a trace water content measuring instrument AQ-100, an automatic heat vaporization water content measuring system AQS-2320 and an automatic water vaporizing instrument SE320 are used in combination, and the water content in the treated magnetic material is measured by Karl Fischer's coulometric titration. As a measuring method, a waiting time (interval) control method is used. Time is set to be 40 seconds; heating temperature, 120° C.; and the amount of the treated magnetic material fed, 2.0 g. The water adsorption per unit area is obtained by this measurement.

The water adsorption per unit area thus obtained and the value of BET specific surface area of the treated magnetic material as measured in the same way as in the above (4) are used to calculate the water adsorption per unit area of the treated magnetic material.

EXAMPLES

The present invention is described below in greater detail by giving production examples and working examples. In the following formulation, the number of part(s) shows part(s) by mass in all occurrences.

Production of Magnetic Iron Oxide 1

In 50 liters of an aqueous ferrous sulfate solution containing 2.0 mol/liter of $Fe^{2+}$, 55 liters of an aqueous 4.0 mol/liter sodium hydroxide solution was mixed, followed by stirring to obtain an aqueous ferrous salt solution containing ferrous hydroxide colloids. This aqueous solution was kept at 85° C., and oxidation reaction was carried out while air was blown into it at a rate of 20 liters/minutes, to obtain a slurry containing core particles. The slurry obtained was filtered with a filter press and washed, and thereafter the core particles were again dispersed in water to make a re-slurry. To this re-slurry solution, sodium silicate was added in an amount providing 0.10 part of silicon per 100 parts of the core particles, and the pH of the slurry solution was adjusted to 6.0, followed by stirring to obtain magnetic iron oxide particles having silicon-rich surfaces.

The slurry obtained was filtered with a filter press and washed, and thereafter re-slurry was made using ion-exchanged water. To this re-slurry solution (solid content: 50 g/liter), 500 g (100% by mass based on the mass of the magnetic iron oxide) of an ion exchange resin SK110 (available from Mitsubishi Chemical Corporation) was introduced, and these were stirred for 2 hours to carry out ion exchange. Thereafter, the ion exchange resin was removed by filtration with a mesh. Further, the product obtained was filtered with a filter press and washed, followed by drying and disintegration to obtain a magnetic iron oxide 1, having a volume average particle diameter (Dv) of 0.21 μm. Physical properties of the magnetic iron oxide 1 thus obtained are shown in Table 1. The TE of the magnetic iron oxide 1 obtained was 5800 mJ.

Production of Magnetic Iron Oxide 2

A magnetic iron oxide 2 was obtained in the same way as Production of Magnetic Iron Oxide 1 except that, in Production of Magnetic Iron Oxide 1, the time for stirring after the ion exchange resin was introduced was changed to 1.5 hours. Physical properties of the magnetic iron oxide 2 thus obtained are shown in Table 1.

Production of Magnetic Iron Oxide 3

A magnetic iron oxide 3 was obtained in the same way as Production of Magnetic Iron Oxide 1 except that, in Production of Magnetic Iron Oxide 1, the time for stirring after the ion exchange resin was introduced was changed to 45 minutes. Physical properties of the magnetic iron oxide 3 thus obtained are shown in Table 1.

Production of Magnetic Iron Oxide 4

A magnetic iron oxide 4 was obtained in the same way as Production of Magnetic Iron Oxide 1 except that, in Production of Magnetic Iron Oxide 1, the time for stirring after the ion exchange resin was introduced was changed to 30 minutes. Physical properties of the magnetic iron oxide 4 thus obtained are shown in Table 1.

Production of Magnetic Iron Oxide 5

A magnetic iron oxide 5 was obtained in the same way as Production of Magnetic Iron Oxide 1 except that, in Production of Magnetic Iron Oxide 1, the ion exchange resin was not introduced. Physical properties of the magnetic iron oxide 5 thus obtained are shown in Table 1.

Production of Magnetic Iron Oxide 6

A magnetic iron oxide 6 was obtained in the same way as Production of Magnetic Iron Oxide 1 except that, in Production of Magnetic Iron Oxide 1, the amount of the sodium silicate to be added was so changed as for the silicon to be 0.30% by mass based on the magnetic material base and that the time for stirring after the ion exchange resin was introduced was changed to 30 minutes. Physical properties of the magnetic iron oxide 6 thus obtained are shown in Table 1.

Production of Magnetic Iron Oxide 7

A magnetic iron oxide 7 was obtained in the same way as Production of Magnetic Iron Oxide 1 except that, in Production of Magnetic Iron Oxide 1, the amount of the sodium silicate to be added was so changed as for the silicon to be 0.50% by mass based on the magnetic material base and that the time for stirring after the ion exchange resin was introduced was changed to 30 minutes. Physical properties of the magnetic iron oxide 6 thus obtained are shown in Table 1.

Production of Magnetic Iron Oxides 8 to 11

Magnetic iron oxides 8 to 11 were obtained in the same way as Production of Magnetic Iron Oxide 1 except that, in Production of Magnetic Iron Oxide 1, the air blowing rate and the oxidation reaction time were controlled and the time for stirring after the ion exchange resin was introduced was changed to 30 minutes. Physical properties of the magnetic iron oxides 8 to 11 thus obtained are shown in Table 1.

Production of Magnetic Iron Oxide 12

A magnetic iron oxide 12 was obtained in the same way as Production of Magnetic Iron Oxide 1 except that, in Production of Magnetic Iron Oxide 1, the amount of the sodium silicate to be added was so changed as for the silicon to be 0.50% by mass based on the magnetic material base and that the air blowing rate and the oxidation reaction time were controlled and the time for stirring after the ion exchange resin was introduced was changed to 30 minutes. Physical properties of the magnetic iron oxide 12 thus obtained are shown in Table 1.

Production of Magnetic Iron Oxide 13

A magnetic iron oxide 13 was obtained in the same way as Production of Magnetic Iron Oxide 1 except that, in Production of Magnetic Iron Oxide 1, the amount of the sodium silicate to be added was so changed as for the silicon to be 0.05% by mass based on the magnetic material base and that the air blowing rate and the oxidation reaction time were controlled and the time for stirring after the ion exchange resin was introduced was changed to 30 minutes. Physical properties of the magnetic iron oxide 13 thus obtained are shown in Table 1.

Production of Magnetic Iron Oxide 14

A magnetic iron oxide 14 was obtained in the same way as Production of Magnetic Iron Oxide 1 except that, in Production of Magnetic Iron Oxide 1, the amount of the sodium silicate to be added was so changed as for the silicon to be 0.03% by mass based on the magnetic material base and that the air blowing rate and the oxidation reaction time were controlled and the time for stirring after the ion exchange resin was introduced was changed to 30 minutes. Physical properties of the magnetic iron oxide 14 thus obtained are shown in Table 1.

Production of Magnetic Iron Oxide 15

A magnetic iron oxide 15 was obtained in the same way as Production of Magnetic Iron Oxide 1 except that, in Production of Magnetic Iron Oxide 1, the amount of the sodium silicate to be added was so changed as for the silicon to be 0.55% by mass based on the magnetic material base and that the air blowing rate and the oxidation reaction time were controlled and the time for stirring after the ion exchange resin was introduced was changed to 30 minutes. Physical properties of the magnetic iron oxide 15 thus obtained are shown in Table 1.

Production of Magnetic Iron Oxide 16

A magnetic iron oxide 16 was obtained in the same way as Production of Magnetic Iron Oxide 1 except that, in Production of Magnetic Iron Oxide 1, the amount of the sodium silicate to be added was so changed as for the silicon to be 0.55% by mass based on the magnetic material base and that and the time for stirring after the ion exchange resin was introduced was changed to 30 minutes. Physical properties of the magnetic iron oxide 15 thus obtained are shown in Table 1.

Production of Magnetic Iron Oxide 17

A magnetic iron oxide 17 was obtained in the same way as Production of Magnetic Iron Oxide 1 except that, in Production of Magnetic Iron Oxide 1, the amount of the sodium silicate to be added was so changed as for the silicon to be 0.03% by mass based on the magnetic material base and that the time for stirring after the ion exchange resin was introduced was changed to 30 minutes. Physical properties of the magnetic iron oxide 17 thus obtained are shown in Table 1.

TABLE 1

| Type of magnetic material base Magnetic iron oxide: | Volume average particle diameter Dv (μm) | BET specific surface area ($m^2/g$) | Silicon content*1 (ms. %) | Alkali metal and/or alkaline earth metal content*2 (ms. %) |
|---|---|---|---|---|
| 1 | 0.21 | 9.2 | 0.10 | 0.0010 |
| 2 | 0.21 | 9.2 | 0.10 | 0.0030 |
| 3 | 0.21 | 9.2 | 0.10 | 0.0050 |
| 4 | 0.21 | 9.2 | 0.10 | 0.0056 |
| 5 | 0.21 | 9.2 | 0.10 | 0.0081 |
| 6 | 0.21 | 9.2 | 0.30 | 0.0062 |
| 7 | 0.21 | 9.2 | 0.50 | 0.0070 |
| 8 | 0.35 | 5.5 | 0.10 | 0.0060 |
| 9 | 0.16 | 12.1 | 0.10 | 0.0065 |
| 10 | 0.40 | 4.2 | 0.10 | 0.0062 |
| 11 | 0.10 | 15.8 | 0.10 | 0.0063 |
| 12 | 0.09 | 17.2 | 0.50 | 0.0069 |
| 13 | 0.42 | 3.9 | 0.05 | 0.0062 |
| 14 | 0.42 | 3.9 | 0.03 | 0.0060 |
| 15 | 0.09 | 17.2 | 0.55 | 0.0072 |
| 16 | 0.21 | 9.2 | 0.55 | 0.0064 |
| 17 | 0.21 | 9.2 | 0.03 | 0.0058 |

*1The level of silicon on magnetic iron oxide core particles, present until the iron element in magnetic iron oxide has come to be in a dissolution percentage of 5%.
*2The level of alkali metal and/or alkaline earth metal on magnetic iron oxide core particles, present until the iron element in magnetic iron oxide has come to be in a dissolution percentage of 5%.

Production of Silane Compound 1

40 parts of iso-$C_4H_9Si(OCH_3)_3$ as a silane coupling agent was dropwise added to 60 parts of ion-exchanged water with stirring, and thereafter dispersed therein for 2 hours by means of a dispersing blade at a peripheral speed of 0.46 m/sec while keeping the mixture at a pH of 5.3 and a temperature of 40° C., to hydrolyze the iso-$C_4H_9Si(OCH_3)_3$. Thereafter, the aqueous solution formed was, with its pH adjusted to 7.0, cooled to 10° C. to stop the reaction of hydrolysis to obtain an aqueous solution containing a silane compound 1, having a hydrolysis percentage of 95%.

Production of Silane Compounds 2 to 4

Aqueous solutions containing silane compounds 2 to 4 were obtained in the same way as Production of Silane Compound 1 except that the time for the dispersion by means of a dispersing blade was changed to 1.5 hours, 1 hour and 45 minutes, respectively. The silane compounds 2 to 4 had hydrolysis percentages of 70%, 50% and 45%, respectively.

Production of Treated Magnetic Material 1

100 parts of the magnetic iron oxide 1 was put into a high-speed mixer (manufactured by Fukae Powtec Co., Ltd.; Model LFS-2), and then stirred at a number of revolutions of 2,000 rpm, during which 8.3 parts of the aqueous solution containing the silane compound 1 was dropwise added thereto over a period of 2 minutes. Thereafter, these were mixed and stirred for 3 hours. Next, the mixture obtained was dried at 120° C. for 1 hour and at the same time the condensation reaction of the alkylalkoxysilane was allowed to proceed. Thereafter, the product obtained was disintegrated and then passed through a sieve of 100 μm in mesh opening to obtain a treated magnetic material 1. Physical properties of the treated magnetic material 1 thus obtained are shown in Table 2.

Production of Treated Magnetic Materials 2 to 20

Treated magnetic materials 2 to 20 were obtained in the same way as Production of Treated Magnetic Material 1 except that, in Production of Treated Magnetic Material 1, the magnetic iron oxide and silane compound to be added were changed in types and amounts as shown in Table 2. Physical properties of the treated magnetic materials 2 to 12 thus obtained are shown in Table 2.

Production of Treated Magnetic Material 21

A treated magnetic material 21 was obtained in the same way as Production of Treated Magnetic Material 1 except that, in Production of Treated Magnetic Material 1, 4 parts of iso-$C_4H_9Si(OCH_3)_3$ was added in place of the silane compound 1. Physical properties of the treated magnetic material 21 thus obtained are shown in Table 2.

Production of Treated Magnetic Material 22

In Production of Magnetic Iron Oxide 4, the magnetic iron oxide particles were obtained and thereafter filtered to first take out a water-containing sample. At this point, the water-containing sample was collected in a small quantity and its water content was beforehand measured. Next, this water-containing sample was, without being dried, introduced into another aqueous medium, and was sufficiently re-dispersed therein with stirring and at the same time circulating the slurry. Then, the silane compound 4 was added thereto with stirring, in an amount of 8.5 parts based on 100 parts of the magnetic iron oxide (the amount of the magnetic iron oxide was calculated as the value found by subtracting the water content from the water-containing sample), and the pH of the dispersion formed was adjusted to 8.6 to carry out surface treatment. The magnetic material obtained was filtered with a filter press and washed, followed by drying at 120° C. for 1 hour to obtain a treated magnetic material 22. Physical properties of the treated magnetic material 22 are shown in Table 2.

Production of Treated Magnetic Material 23

In 50 liters of an aqueous ferrous sulfate solution containing 2.0 mol/liter of $Fe^{2+}$, 55 liters of an aqueous 4.0 mol/liter sodium hydroxide solution was mixed to prepare an aqueous solution containing ferrous hydroxide. Keeping this aqueous solution to a pH of 9, air was blown into it, where oxidation reaction was carried out at 80° C. to prepare a slurry for forming seed crystals.

Next, an aqueous ferrous sulfate solution was so added to this slurry as to be 0.9 equivalent weight or more to 1.2 equivalent weight or less, based on the initial alkali quantity (sodium component of sodium hydroxide). Thereafter, the slurry was kept to a pH of 8, and air was blown into it, during which the oxidation reaction was allowed to proceed. At the stage of termination of the oxidation reaction, the pH was adjusted to about 6, where, as silane coupling agents, n-$C_6H_{13}Si(OCH_3)_3$ and n-$C_8H_{17}Si(OC_2H_5)_3$ were added in amounts of 0.6 part and 0.9 part, respectively, and these were thoroughly stirred. The hydrophobic magnetic iron oxide particles thus formed were washed, filtered and dried all by conventional methods, and then particles standing agglomerate were subjected to disintegration treatment to obtain a treated magnetic material 23. Physical properties of the treated magnetic material 23 obtained are shown in Table 2.

Production of Treated Magnetic Material 24

A treated magnetic material 24 was obtained in the same way as Production of Treated Magnetic Material 23 except that, in Production of Treated Magnetic Material 23, as silane compounds, n-$C_4H_9Si(OCH_3)_3$ and n-$C_8H_{17}Si(OC_2H_5)_3$ were added in amounts of 0.6 part and 0.9 part, respectively. Physical properties of the treated magnetic material 24 obtained are shown in Table 2.

TABLE 2

| | Magnetic material base | Hydrophobic-treating agent | | | | |
|---|---|---|---|---|---|---|
| | Magnetic iron oxide | Type | Amount of treatment pbm | Amount of treatment BET | Water adsorption (mg/m$^2$) | Fluidity TE (mJ) |
| | | Treated magnetic material: | | | | |
| 1 | 1 | Silane compound 1 | 3.3 | 0.36 | 0.20 | 1,400 |
| 2 | 1 | Silane compound 2 | 3.3 | 0.36 | 0.19 | 1,440 |
| 3 | 1 | Silane compound 3 | 3.3 | 0.36 | 0.22 | 1,500 |
| 4 | 2 | Silane compound 3 | 3.3 | 0.36 | 0.23 | 1,560 |
| 5 | 3 | Silane compound 3 | 3.3 | 0.36 | 0.24 | 1,600 |
| 6 | 3 | Silane compound 4 | 3.3 | 0.36 | 0.25 | 1,630 |
| 7 | 4 | Silane compound 4 | 3.3 | 0.36 | 0.25 | 1,650 |
| 8 | 5 | Silane compound 4 | 3.3 | 0.36 | 0.27 | 1,800 |
| 9 | 8 | Silane compound 4 | 3.3 | 0.36 | 0.30 | 1,920 |
| 10 | 6 | Silane compound 4 | 3.3 | 0.36 | 0.30 | 2,000 |
| 11 | 9 | Silane compound 4 | 2.0 | 0.36 | 0.22 | 750 |
| 12 | 7 | Silane compound 4 | 4.4 | 0.36 | 0.28 | 2,000 |
| 13 | 10 | Silane compound 4 | 1.5 | 0.36 | 0.23 | 500 |
| 14 | 11 | Silane compound 4 | 5.7 | 0.36 | 0.29 | 2,400 |
| 15 | 13 | Silane compound 4 | 6.2 | 0.36 | 0.30 | 2,550 |
| 16 | 12 | Silane compound 4 | 1.4 | 0.36 | 0.32 | 480 |
| 17 | 14 | Silane compound 4 | 1.4 | 0.36 | 0.00 | 2,600 |
| 18 | 15 | Silane compound 4 | 6.2 | 0.36 | 0.32 | 450 |
| 19 | 16 | Silane compound 4 | 3.3 | 0.36 | 1.65 | 2,400 |
| 20 | 17 | Silane compound 4 | 3.3 | 0.36 | 0.40 | 2,100 |
| 21 | 1 | Iso-$C_4H_9Si(OCH_3)_3$ | 4.0 | 0.43 | 0.43 | 2,200 |
| 22 | 4 | Silane compound 4 | 3.3 | 0.36 | 1.65 | 2,900 |
| 23 | — | n-$C_6H_{13}Si(OCH_3)_3$/ n-$C_8H_{17}Si(OC_2H_5)_3$ | 0.6/ 0.9 | — | 0.43 | 2,500 |
| 24 | — | n-$C_4H_9Si(OCH_3)_3$/ n-$C_8H_{17}Si(OC_2H_5)_3$ | 0.6/ 0.9 | — | 1.65 | 3,000 |

Production of Magnetic Toner 1

Into 720 parts of ion-exchanged water, 450 parts of an aqueous 0.1 mol/liter $Na_2PO_4$ solution was introduced, followed by heating to 60° C. Thereafter, 67.7 parts of an aqueous 1.0 mol/liter $CaCl_2$ solution was added thereto to obtain an aqueous medium containing a dispersion stabilizer.

| | |
|---|---|
| Styrene | 78.0 parts |
| n-Butyl acrylate | 22.0 parts |
| Divinylbenzene | 0.6 part |
| Iron complex of monoazo dye (T-77, available from Hodogaya Chemical Co., Ltd.) | 1.5 parts |
| Treated magnetic material 1 | 90.0 parts |
| Saturated polyester resin (saturated polyester resin obtained by condensation reaction of terephthalic acid with an ethylene oxide addition product of bisphenol A; Mn: 5,000; acid value: 12 mgKOH/g; Tg: 68° C.) | 7.0 parts |

Materials formulated as above were uniformly dispersed and mixed by means of an attritor (manufactured by Mitsui Miike Engineering Corporation) to obtain a monomer composition. The monomer composition thus obtained was heated to 60° C., and 12.0 parts of Fischer-Tropsch wax was added thereto and mixed to dissolve it. Thereafter, 7.0 parts of dilauroyl peroxide as a polymerization initiator was dissolved to prepare a polymerizable monomer composition.

The polymerizable monomer composition was introduced into the above aqueous medium, followed by stirring for 10 minutes at 60° C. in an atmosphere of $N_2$, using TK type homomixer (manufactured by Tokushu Kika Kogyo Co., Ltd.) at 12,000 rpm to carry out granulation. Thereafter, the granulated product obtained was stirred with a paddle stirring blade, during which the reaction was carried out at 74° C. for 6 hours.

After the reaction was completed, the suspension formed was cooled, and hydrochloric acid was added thereto to effect washing, followed by filtration and then drying to obtain toner particles 1.

100 parts of the toner particles 1 (toner base particles) obtained and 1.0 part of hydrophobic fine silica powder of 12 nm in number average primary particle diameter were mixed by means of Henschel mixer (manufactured by Mitsui Miike Engineering Corporation) to obtain a magnetic toner 1 having a weight average particle diameter (D4) of 6.5 μm. The magnetic toner obtained was analyzed to find that it contained 100 part of the binder resin. Physical properties of the magnetic toner 1 obtained are shown in Table 3.

Production of Magnetic Toners 2 to 25

Magnetic toners 2 to 25 were obtained in the same way as Production of Magnetic Toner 1 except that the treated magnetic material 1 was changed for the treated magnetic materials shown in Table 3 or the magnetic iron oxide 1 for magnetic toner 25. Physical properties of the magnetic toners 2 to 25 obtained are shown in Table 3.

Production of Magnetic Toner 26

| | |
|---|---|
| Styrene-acrylate resin (resin obtained by polymerizing 75 parts of styrene and 24.5 parts of n-butyl acrylate in the presence of 0.5 part of 2-ethylhexyl peroxydicarbonate) | 100.0 parts |
| Magnetic iron oxide 1 | 90.0 parts |
| Monoazo iron complex (T-77, available from Hodogaya Chemical Co., Ltd.) | 2.0 parts |
| Polyethylene wax | 4.0 parts |

A mixture of the above was premixed by means of Henschel mixer, and thereafter melt-kneaded by means of a twin-screw extruder heated to 110° C., to obtain a kneaded product, which was then cooled and the kneaded product cooled was crushed by using a hammer mill to obtain a crushed product. The crushed product obtained was finely pulverized by means of a mechanical grinding machine Turbo mill (manufactured by Turbo Kogyo Co., Ltd.). The finely pulverized product thus obtained was classified by means of a multi-division classifier (Elbow Jet Classifier, manufactured by Nittetsu Mining Co., Ltd.).

The finely pulverized product thus classified was subjected to particle surface modification and removal of fine particles by means of a surface modifying apparatus FACULTY (manufactured by Hosokawa Micron Corporation) to obtain magnetic toner particles 26.

To the magnetic toner particles 26 (toner base particles) obtained, the like hydrophobic fine silica powder was externally added in the same way as in Production of Magnetic Toner 1 to obtain a magnetic toner 26. Physical properties of the magnetic toner 26 obtained are shown in Table 3.

Production of Magnetic Toner 27

A magnetic toner 27 was obtained in the same way as Production of Magnetic Toner 26 except that the raw materials were changed as shown below. Physical properties of the magnetic toner 27 obtained are shown in Table 3.

| | |
|---|---|
| Polyester resin (peak molecular weight: 6,100; acid value: 18.5 mgKOH/g) | 100.0 parts |

-continued

| | |
|---|---|
| Magnetic iron oxide 1 | 90.0 parts |
| Monoazo iron complex (T-77, available from Hodogaya Chemical Co., Ltd.) | 2.0 parts |
| Polyethylene wax | 4.0 parts |

Production of Magnetic Toner 28

A magnetic toner 28 was obtained in the same way as Production of Magnetic Toner 26 except that the raw materials were changed as shown below. Physical properties of the magnetic toner 28 obtained are shown in Table 3.

| | |
|---|---|
| Polyester resin (peak molecular weight: 6,100; acid value: 18.5 mgKOH/g) | 75.0 parts |
| Styrene-acrylate resin (resin obtained by polymerizing 75 parts of styrene and 24.5 parts of n-butyl acrylate in the presence of 0.5 part of 2-ethylhexyl peroxydicarbonate) | 25.0 parts |
| Magnetic iron oxide 1 | 90.0 parts |
| Monoazo iron complex (T-77, available from Hodogaya Chemical Co., Ltd.) | 2.0 parts |
| Polyethylene wax | 4.0 parts |

TABLE 3

| | Magnetic material, M | ε" (pF/m) | $\tan\delta_L$ | Temp. at which tanδ shows max. value (° C.) | Value of ($\tan\delta_H - \tan\delta_L$) |
|---|---|---|---|---|---|
| | Magnetic toner: | | | | |
| 1 | Treated M 1 | $3.5 \times 10^{-1}$ | $1.1 \times 10^{-2}$ | 112 | $1.7 \times 10^{-2}$ |
| 2 | Treated M 2 | $3.6 \times 10^{-1}$ | $1.1 \times 10^{-2}$ | 112 | $1.8 \times 10^{-2}$ |
| 3 | Treated M 3 | $3.7 \times 10^{-1}$ | $1.2 \times 10^{-2}$ | 111 | $1.9 \times 10^{-2}$ |
| 4 | Treated M 4 | $3.9 \times 10^{-1}$ | $1.4 \times 10^{-2}$ | 113 | $1.9 \times 10^{-2}$ |
| 5 | Treated M 5 | $4.0 \times 10^{-1}$ | $1.5 \times 10^{-2}$ | 114 | $2.0 \times 10^{-2}$ |
| 6 | Treated M 6 | $4.2 \times 10^{-1}$ | $1.6 \times 10^{-3}$ | 112 | $2.0 \times 10^{-2}$ |
| 7 | Treated M 7 | $4.2 \times 10^{-1}$ | $1.6 \times 10^{-2}$ | 112 | $2.1 \times 10^{-2}$ |
| 8 | Treated M 8 | $4.6 \times 10^{-1}$ | $1.8 \times 10^{-2}$ | 111 | $2.2 \times 10^{-2}$ |
| 9 | Treated M 9 | $6.0 \times 10^{-1}$ | $2.6 \times 10^{-2}$ | 113 | $2.6 \times 10^{-2}$ |
| 10 | Treated M 10 | $6.2 \times 10^{-1}$ | $2.9 \times 10^{-3}$ | 113 | $2.8 \times 10^{-2}$ |
| 11 | Treated M 11 | $5.9 \times 10^{-1}$ | $2.3 \times 10^{-2}$ | 110 | $2.5 \times 10^{-2}$ |
| 12 | Treated M 12 | $2.7 \times 10^{-1}$ | $9.0 \times 10^{-3}$ | 111 | $1.8 \times 10^{-2}$ |
| 13 | Treated M 13 | $6.2 \times 10^{-1}$ | $2.5 \times 10^{-2}$ | 110 | $2.7 \times 10^{-2}$ |
| 14 | Treated M 14 | $2.8 \times 10^{-1}$ | $1.1 \times 10^{-2}$ | 112 | $1.8 \times 10^{-2}$ |
| 15 | Treated M 15 | $2.5 \times 10^{-1}$ | $9.0 \times 10^{-3}$ | 114 | $1.6 \times 10^{-2}$ |
| 16 | Treated M 16 | $7.0 \times 10^{-1}$ | $3.0 \times 10^{-2}$ | 109 | $3.0 \times 10^{-2}$ |
| 17 | Treated M 17 | $2.4 \times 10^{-1}$ | $1.2 \times 10^{-2}$ | 113 | $1.8 \times 10^{-2}$ |
| 18 | Treated M 18 | $7.2 \times 10^{-1}$ | $3.5 \times 10^{-2}$ | 110 | $3.4 \times 10^{-2}$ |
| 19 | Treated M 19 | $6.5 \times 10^{-1}$ | $3.0 \times 10^{-2}$ | 112 | $3.1 \times 10^{-2}$ |
| 20 | Treated M 20 | $5.5 \times 10^{-1}$ | $2.8 \times 10^{-3}$ | 111 | $3.1 \times 10^{-2}$ |
| 21 | Treated M 21 | $6.8 \times 10^{-1}$ | $3.3 \times 10^{-3}$ | 113 | $3.4 \times 10^{-2}$ |
| 22 | Treated M 22 | $5.3 \times 10^{-1}$ | $2.1 \times 10^{-2}$ | 111 | $5.0 \times 10^{-2}$ |
| 23 | Treated M 23 | $1.6 \times 10^{-1}$ | $4.8 \times 10^{-3}$ | 112 | $9.0 \times 10^{-3}$ |
| 24 | Treated M 24 | $6.7 \times 10^{-1}$ | $2.3 \times 10^{-2}$ | 112 | $5.0 \times 10^{-2}$ |
| 25 | Magnetic iron oxide 1 | $8.0 \times 10^{-1}$ | $5.2 \times 10^{-2}$ | 115 | $3.7 \times 10^{-2}$ |
| 26 | Magnetic iron oxide 1 | $6.4 \times 10^{-1}$ | $3.2 \times 10^{-2}$ | 120 | $8.3 \times 10^{-2}$ |
| 27 | Magnetic iron oxide 1 | $2.2 \times 10^{-1}$ | $6.2 \times 10^{-2}$ | 115 | $6.8 \times 10^{-2}$ |
| 28 | Magnetic iron oxide 1 | $1.3 \times 10^{-1}$ | $7.2 \times 10^{-2}$ | 114 | $2.1 \times 10^{-2}$ |

Examples 1 to 16 & Comparative Examples 1 to 12

The magnetic toners 1 to 28 were used to evaluate them in the following way. The results of evaluation are shown in Table 4.

Leaving Test in Low-Temperature and Low-Humidity Environment:

Evaluation was made by using a digital copying machine GP-405, manufactured by CANON INC. The magnetic toner to be evaluated was supplied thereto and thereafter these were temperature- and humidity-conditioned for 24 hours in a low-temperature and low-humidity environment (10° C./10% RH).

Images with a print percentage of 4% were reproduced on 10,000 sheets, and thereafter the copying machine having the magnetic toner was left to stand in the like environment. After the leaving, a chart in which solid black image areas were formed on its whole print paper surface was reproduced on one sheet. Then, the reflection density of the solid black images formed was measured with MACBETH Densitometer (manufactured by Gretag Macbeth Ag.) using an SPI filter, and was evaluated according to the following criteria. The results of evaluation mean that "A" is excellent and what becomes closer to "E" is more inferior thereto.

A: The reflection density is 1.55 or more.

B: The reflection density is 1.50 or more to less than 1.55.

C: The reflection density is 1.45 or more to less than 1.50.

D: The reflection density is 1.35 or more to less than 1.45.

E: The reflection density is less than 1.35.

After the solid black images were reproduced, solid white images were also reproduced, and the reflectance thereof was measured with REFLECTOMETER MODEL TC-6DS, manufactured by Tokyo Denshoku Co., Ltd. Meanwhile, the reflectance was also measured in the same way on a transfer sheet (reference sheet) before the solid white image was formed thereon. A green filter was used as a filter, and fog (reflectance) was calculated by using the following expression.

Fog (%)=reflectance (%) of reference sheet−reflectance (%) of white-image sample.

On the fog, evaluation was made according to the following criteria, using the maximum value of fog values found. The results of evaluation mean that "A" is excellent and what becomes closer to "E" is more inferior thereto.

A: Less than 0.5%.

B: From 0.5% or more to less than 1.0%.

C: From 1.0% or more to less than 1.5%.

D: From 1.5% or more to less than 2.5%.

E: 2.5% or more.

Leaving Test in High-Temperature and High-Humidity Environment:

Evaluation was made by using a digital copying machine GP-405, manufactured by CANON INC. The magnetic toner to be evaluated was supplied thereto and thereafter these were temperature- and humidity-conditioned for 24 hours in a high-temperature and high-humidity environment (32.5° C./80% RH).

Images with a print percentage of 4% were reproduced on 10,000 sheets. Thereafter, the magnetic toner was manually replenished, and the copying machine having the magnetic toner was left to stand in the like environment. After the leaving, a chart was reproduced in which a plurality of solid images of 10 mm×10 mm each were arranged on the leading-end side half of a transfer sheet and a two-dot and three-space halftone image was formed on the rear-end side half thereof.

How far any marks of the solid images appeared on the halftone image was visually examined to make evaluation on sleeve ghost. Evaluation criteria are as follows:

A: Any ghost does not occur.

B: Ghost is slightly seen.

C: Ghost is seen, but at a level tolerable in practical use.

D: Ghost is clearly seen.

Next, solid white images were reproduced, and evaluation on fog was made in the same way as the case of low-temperature and low-humidity environment. Evaluation criteria are also alike.

Toner-At-Replenishing Test in High-Temperature and High-Humidity Environment:

Evaluation was made by using a digital copying machine GP-405, manufactured by CANON INC. The magnetic toner to be evaluated was supplied thereto and thereafter these were temperature- and humidity-conditioned for 24 hours in a high-temperature and high-humidity environment (32.5° C./80% RH).

Next, images with a print percentage of 4% were reproduced on 10,000 sheets, and thereafter the magnetic toner was manually replenished. Immediately after it was replenished, a chart in which solid black image areas were formed on its whole print paper surface was reproduced on one sheet. Then, the reflection densities at four spots on corners within the images and at the middle thereof, five spots in total, were measured with MACBETH Densitometer (manufactured by Gretag Macbeth Ag.) using an SPI filter.

The reflection density of images was evaluated by its difference between the area where it was highest and the area where it was lowest, and according to the following criteria. The results of evaluation mean that "A" is excellent and what becomes closer to "E" is more inferior thereto.

A: Less than 0.03.

B: From 0.03 or more to less than 0.06.

C: From 0.06 or more to less than 0.10.

D: From 0.10 or more to less than 0.15.

E: 0.15 or more.

TABLE 4

| | | Leaving test in low-temp. low-humidity environment | | Leaving test & toner-at-replenishing test in high-temp. high-humidity environment | | |
|---|---|---|---|---|---|---|
| | Magnetic toner | Image density | Fog | Fog | Sleeve ghost | Image uniformity |
| Example: | | | | | | |
| 1 | 1 | A(1.56) | A(0.2%) | A(0.2%) | A | A(0.02) |
| 2 | 2 | A(1.56) | A(0.2%) | A(0.3%) | A | B(0.03) |
| 3 | 3 | A(1.55) | A(0.3%) | A(0.3%) | A | B(0.04) |
| 4 | 4 | A(1.55) | A(0.3%) | A(0.4%) | A | B(0.04) |

TABLE 4-continued

| | | Leaving test in low-temp. low-humidity environment | | Leaving test & toner-at-replenishing test in high-temp. high-humidity environment | | |
|---|---|---|---|---|---|---|
| | Magnetic toner | Image density | Fog | Fog | Sleeve ghost | Image uniformity |
| 5 | 5 | A(1.56) | A(0.3%) | B(0.5%) | A | B(0.04) |
| 6 | 6 | A(1.55) | A(0.4%) | B(0.6%) | A | B(0.05) |
| 7 | 7 | A(1.55) | A(0.3%) | B(0.7%) | A | B(0.04) |
| 8 | 8 | A(1.55) | B(0.5%) | B(0.8%) | B | B(0.05) |
| 9 | 9 | B(1.54) | B(0.6%) | B(0.8%) | C | B(0.05) |
| 10 | 10 | B(1.53) | B(0.8%) | B(0.9%) | C | C(0.06) |
| 11 | 11 | A(1.55) | A(0.4%) | C(1.2%) | B | B(0.05) |
| 12 | 12 | B(1.52) | B(0.6%) | B(0.9%) | A | A(0.02) |
| 13 | 13 | B(1.53) | B(0.9%) | C(1.3%) | C | C(0.07) |
| 14 | 14 | C(1.48) | C(1.1%) | B(0.8%) | B | B(0.05) |
| 15 | 15 | D(1.44) | C(1.3%) | C(1.2%) | C | C(0.08) |
| 16 | 16 | C(1.47) | C(1.4%) | C(1.4%) | D | D(0.11) |
| Comparative Example: | | | | | | |
| 1 | 17 | D(1.44) | D(1.5%) | D(1.6%) | D | C(0.08) |
| 2 | 18 | D(1.43) | D(1.7%) | D(1.8%) | D | E(0.15) |
| 3 | 19 | C(1.47) | D(1.7%) | D(1.9%) | D | D(0.14) |
| 4 | 20 | C(1.46) | C(1.4%) | D(1.6%) | D | D(0.13) |
| 5 | 21 | D(1.44) | D(1.5%) | D(1.7%) | D | E(0.16) |
| 6 | 22 | D(1.42) | D(1.7%) | D(1.8%) | D | D(0.14) |
| 7 | 23 | D(1.40) | D(1.8%) | D(1.8%) | C | C(0.09) |
| 8 | 24 | D(1.39) | C(1.4%) | D(2.0%) | C | E(0.15) |
| 9 | 25 | E(1.30) | E(2.6%) | D(2.4%) | E | E(0.16) |
| 10 | 26 | C(1.46) | D(1.5%) | C(1.4%) | D | E(0.21) |
| 11 | 27 | E(1.28) | E(2.3%) | D(2.1%) | D | E(0.19) |
| 12 | 28 | D(1.34) | E(2.6%) | D(2.4%) | D | D(0.14) |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-123734, filed May 31, 2010, which is hereby incorporated by reference herein in its entirety.

The invention claimed is:

1. A magnetic toner comprising magnetic toner particles, the magnetic toner particles are produced by suspension polymerization, each of the magnetic toner particles comprises a magnetic toner base particle containing a binder resin and a magnetic material, and an inorganic fine powder;

(a) the magnetic toner having, at a frequency of 100 kHz and a temperature of 30° C., a dielectric loss factor (∈") of from $2.5\times10^{-1}$ pF/m or more to $7.0\times10^{-1}$ pF/m or less and a dielectric dissipation factor ($\tan\delta_L$) of $3.0\times10^{-2}$ or less;

(b) the magnetic toner having, in a dielectric dissipation factor ($\tan\delta$) thereof at a frequency of 100 kHz, a maximum value ($\tan\delta_H$) within the temperature range of from 60° C. to 140° C.; and the $\tan\delta_H$ and the $\tan\delta_L$ satisfying $(\tan\delta_H-\tan\delta_L)\leq3.0\times10^{-2}$.

2. The magnetic toner according to claim 1, wherein the magnetic material has a total energy (TE) of from 500 mJ or more to 2,000 mJ or less at the time of a stirring speed of 100 rpm, as measured with a powder fluidity measuring instrument.

3. The magnetic toner according to claim 1, wherein the magnetic material is a magnetic iron oxide having been subjected to hydrophobic treatment.

4. The magnetic toner according to claim 3, wherein the magnetic material has a water adsorption per unit area of 0.30 $mg/m^2$ or less.

5. The magnetic toner according to claim 3, wherein the magnetic iron oxide contains silicon, and the content of the silicon is in a level of from 0.05% by mass or more to 0.50% by mass or less, based on the mass of the magnetic iron oxide, when measured by dispersing the magnetic iron oxide in an aqueous hydrochloric acid solution and dissolving it therein until the dissolution percentage of iron has come to 5% by mass based on the whole iron element contained in the magnetic iron oxide.

6. The magnetic toner according to claim 3, wherein the content of an alkali metal and/or alkaline earth metal is in a total level of 0.010% by mass or less, based on the mass of the magnetic iron oxide, when measured by dispersing the magnetic iron oxide in an aqueous hydrochloric acid solution and dissolving it therein until the dissolution percentage of the iron element has come to 5% by mass based on the whole iron element contained in the magnetic iron oxide.

* * * * *